US006232728B1

(12) United States Patent
Yamamoto et al.

(10) Patent No.: US 6,232,728 B1
(45) Date of Patent: May 15, 2001

(54) DISCHARGE LAMP APPARATUS

(75) Inventors: Noboru Yamamoto, Kariya; Goichi Oda, Shimizu; Tomoyuki Funayama, Toyota, all of (JP)

(73) Assignees: Denso Corporation, Kariya; Koito Manufacturing Co., Ltd., Tokyo, both of (JP)

( * ) Notice: Subject to any disclaimer, the term of this patent is extended or adjusted under 35 U.S.C. 154(b) by 0 days.

(21) Appl. No.: 09/304,840

(22) Filed: May 5, 1999

(30) Foreign Application Priority Data

May 8, 1998 (JP) ..... 10-126292
May 8, 1998 (JP) ..... 10-126293
May 8, 1998 (JP) ..... 10-126294

(51) Int. Cl.[7] ..... G05F 1/00

(52) U.S. Cl. ..... 315/307; 315/291; 315/297; 315/DIG. 7

(58) Field of Search ..... 315/225, 307, 315/209 R, 291, 297, DIG. 7, 224, 276

(56) References Cited

U.S. PATENT DOCUMENTS

| | | | |
|---|---|---|---|
| 5,068,570 | 11/1991 | Oda et al. | 315/128 |
| 5,142,203 | 8/1992 | Oda et al. | 315/308 |
| 5,212,428 | 5/1993 | Sasaki et al. | 315/308 |
| 5,295,036 | 3/1994 | Yagi et al. | 361/79 |
| 5,422,548 | 6/1995 | Yamashita et al. | 315/308 |
| 5,449,973 | 9/1995 | Yamashita et al. | 315/82 |
| 5,485,059 | 1/1996 | Yamashita et al. | 315/307 |
| 5,572,094 | 11/1996 | Yamashita et al. | 315/308 |
| 5,629,588 | 5/1997 | Oda et al. | 315/308 |
| 5,650,694 * | 7/1997 | Jayaraman et al. | 315/225 |
| 5,705,877 * | 1/1998 | Shimada | 310/318 |
| 5,706,185 * | 1/1998 | Toyama et al. | 315/307 |
| 5,751,121 | 5/1998 | Toyama et al. | 315/307 |
| 5,828,177 | 10/1998 | Toda et al. | 315/127 |
| 5,880,563 * | 3/1999 | Toyama et al. | 315/225 |
| 6,060,843 * | 5/2000 | Primisser et al. | 315/291 |

FOREIGN PATENT DOCUMENTS 8-321389 12/1996 (JP) .

* cited by examiner

*Primary Examiner*—Don Wong
*Assistant Examiner*—Tuyet T. Vo
(74) *Attorney, Agent, or Firm*—Pillsbury Madison & Sutro LLP

(57) ABSTRACT

In a discharge lamp apparatus for a vehicle, it is determined that a grounded condition is present when a lamp voltage is less than a predetermined voltage and a lamp current is less than a predetermined current. Electric power supply to the lamp is stopped temporarily in response to the determination of the grounded condition, and then the lighting operation is restarted again. If the grounded condition is determined again, the above operation is repeated. If this repetition continues for a predetermined period, the lighting operation is disabled continuously. In controlling the lamp, a voltage of a battery is boosted by a voltage booster transformer, which is turned on and off by a MOS transistor so that electric power supplied to the lamp is duty-controlled. An upper limit is set to the duty ratio, and the upper limit is increased as the lamp current decreases, so that the lighting characteristics of the lamp is improved. A starter transformer has a closed magnetic circuit core, and is encased within a ballast casing, which is disposed under the lamp.

13 Claims, 17 Drawing Sheets

DISCHARGE LAMP APPARATUS

CROSS REFERENCE TO RELATED APPLICATION

This application relates to and incorporates herein by reference Japanese Patent Applications No. 10-126292, 10-126293 and 10-126294, all being filed on May 8, 1998.

BACKGROUND OF THE INVENTION

1. Field of the Invention

The present invention relates to a discharge lamp apparatus, which drives a high voltage discharge lamp and is preferably used as a vehicle front light.

2. Description of Related Art

Various discharge lamp apparatuses are proposed (e.g., JP-A-9-180888 (U.S. Pat. No. 5,751,121) and JP-A-8-321389), which use a high voltage discharge lamp (lamp) as a vehicle front light, drives the lamp by alternating current (a.c.) voltage after boosting a voltage of a vehicle-mounted battery by a transformer and switching the polarity of the high voltage by an inverter circuit.

This lamp is mounted inside of a reflector provided at a vehicle front part. When an electric wiring part of the lamp is grounded accidentally, an excessive current flows and melts a fusible link or damage circuit devices in the discharge lamp apparatus.

Further, a switching device is provided at a primary side of a voltage boosting transformer to control a primary current, and controls electric power supplied to the lamp by pulse width modulation (PWM) control based on a lamp voltage and a lamp current. In this PWM control, when the duty ratio is increased to increase the electric power of the lamp, the secondary side output of the transformer decreases oppositely. Therefore, a maximum duty ratio is set to limit the duty ratio to be less than a maximum.

However, if the maximum duty ratio is set as above, the lamp can not be supplied with sufficient electric power when the lamp does not continue to light because of decrease in the lamp current at the time of starting lighting the lamp.

Still further, in the above discharge lamp apparatus, an electronic unit for the lamp is encased within a ballast housing, and the ballast housing is mounted outside of the lamp. Thus, extra space is required at the outside of the lamp for installing the electronic unit.

SUMMARY OF THE INVENTION

It is a primary object of the present invention to improve operation characteristics of a discharge lamp apparatus.

More specifically, the present invention aims to improve fail-safe operation when an electric wiring part of a lamp is grounded, to improve lighting characteristics of a lamp, or to improve mountability of a starter transformer in a lamp.

According to one aspect of the present invention, it is determined to be a grounded condition when a voltage between a transformer and an inverter circuit is less than a predetermined voltage and a current flowing to a negative side of a d.c. voltage source is less than a predetermined current. At this occasion, electric power supply to a discharge lamp is stopped temporarily by turning off a plurality of switching devices in an inverter circuit. Thereafter, the electric power supply is restarted by the plurality of the switching devices.

When the grounded condition is determined again after starting the electric power supply, the electric power supply is repeatedly stopped and started. All the plurality of the switching devices are held turned off, when the repetition of stopping and starting of the electric power supply continues for a predetermined period of time.

According to a second aspect of the present invention, an upper limit value is set for a duty ratio of a switching device connected to a primary side of a transformer. This upper limit is varied by a battery voltage, lamp voltage, and a lamp current flowing in a lamp. The upper limit increases as the current decreases. Thus, the secondary side output of the transformer can be increased sufficiently to improve the lighting characteristics of the lamp.

According to a third aspect of the present invention, a ballast casing encasing a starter transformer is mounted in a lamp. A cross sectional area S of a closed magnetic circuit core of the starter transformer and an inside height H of the ballast casing are determined to satisfy a relation of $H \leqq -0.0015\,S^2+0.54 \cdot S-11.49$. A gap of the core is located at the central part side in the ballast casing.

BRIEF DESCRIPTION OF THE DRAWINGS

Other objects, features and advantages of the present invention will be understood more fully from the following detailed description made with reference to the drawings.

DETAILED DESCRIPTION OF THE PREFERRED EMBODIMENT

The present invention will be described in detail with reference to various embodiments and modifications.

(First Embodiment)

Figure 1:
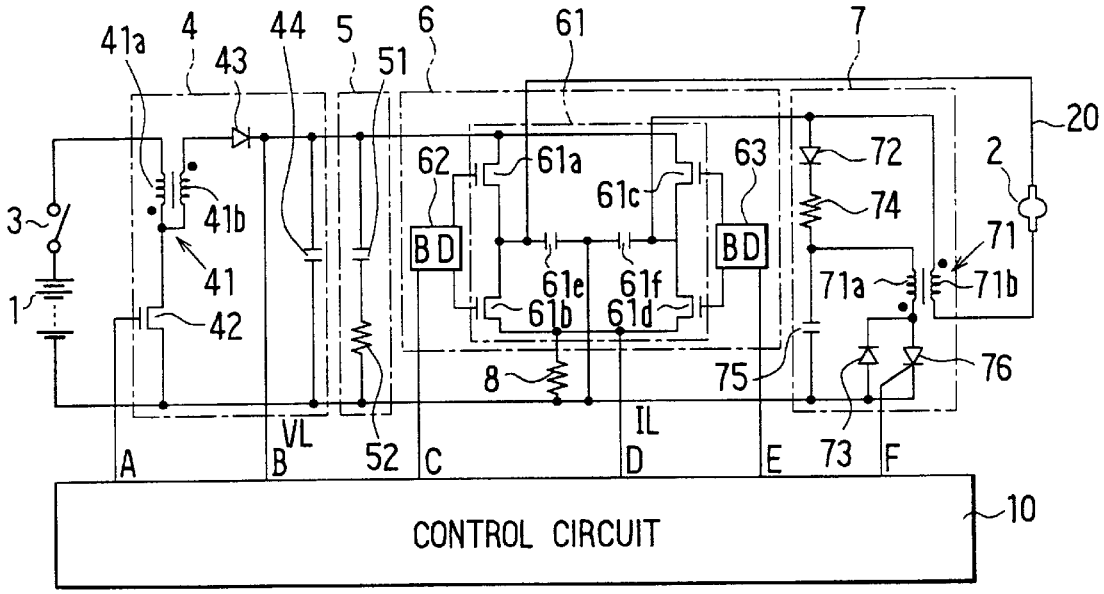
FIG. 1 is an electric wiring diagram showing a discharge lamp apparatus according to a first embodiment of the present invention.

Referring first to FIG. 1 showing an electronic unit of a discharge lamp apparatus, numeral 1 designates a vehicle-mounted storage battery as a direct current power source, numeral 2 designates a discharge lamp such as a metal halide type or the like that is used as a front light of a vehicle, and numeral 3 designates a lighting switch for the lamp 2.

The discharge lamp apparatus has a direct current power source circuit (DC-DC converter) 4, a takeover circuit 5, an inverter circuit 6, a starting circuit 7 and the like.

The DC-DC converter circuit 4 is provided with a flyback transformer 41 which has a primary winding 41*a* arranged on the side of the battery 1 and a secondary winding 41*b* arranged on the side of the lamp 2, a MOS transistor 42 connected to the primary winding 41*a*, and a rectifying diode 43 and a smoothing capacitor 44 which are connected to the secondary winding 41*b*, so that it boosts a battery voltage VB to produce a boosted voltage. That is, when the MOS transistor 42 turns on, a primary current flows through the primary winding 41*a* and energy is stored in the primary winding 41*a*. When the MOS transistor 42 turns off, the energy stored in the primary winding 41*a* is supplied to the secondary winding 41*b*. By repeating this operation, the high voltage is produced from a junction between the diode 43 and the smoothing capacitor 44. The flyback transformer 41 is constructed so that the primary winding 41*a* and the secondary winding 41*b* are electrically conductive.

The takeover circuit 5 comprises a capacitor 51 and a resistor 52. When the lighting switch 3 is turned on, the capacitor 51 is charged so that the lamp 2 swiftly shifts from a dielectric breakdown between its electrodes to an arc discharge.

The inverter circuit 6 is for driving the lamp 2 by alternating current, and comprises a H-bridge circuit 61 and bridge driving circuits 62 and 63. The H-bridge circuit 61 includes MOS transistors 61*a*–61*d* comprising semiconductor switching devices arranged in a bridge shape. The bridge driving circuits 62 and 63 turns on and off the MOS transistors 61*a*, 61*d* and the MOS transistors 61*b*, 61*c* alternately. As a result, the direction of discharge current of the lamp 2 is reversed alternately, so that the polarity of the voltage (discharge voltage) applied to the lamp 2 is reversed alternately to light the lamp 2 by the alternating voltage.

Capacitors 61*e* and 61*f* are protective capacitors for protecting the H-bridge circuit 61 from high voltage pulses generated at the time of starting lighting.

The starting circuit 7 is provided between a neutral potential point of the H-bridge circuit 61 and the negative polarity terminal of the battery 1 to start driving the lighting of the lamp 2. It comprises a starter transformer 71 with a primary winding 71*a* and a secondary winding 71*b*, diodes 72 and 73, a resistor 74, capacitor 75 and a thyristor 76 which is a unidirectional semiconductor device. That is, the capacitor 75 starts charging when the lighting switch 3 turns on. Thereafter, the capacitor 75 starts discharging when the thyristor 76 turns on, and applies the high voltage to the lamp 2 through the starter transformer 71. As a result, the lamp 2 lights by the dielectric breakdown between its electrodes.

The MOS transistor 42, the bridge circuits 62 and 63 and the thyristor 76 are controlled by a control circuit 10. The control circuit 10 is constructed to receive a lamp voltage VL between the DC-DC converter 4 and the inverter circuit 6 (voltage applied to the inverter circuit 6) and a lamp current IL flowing from the inverter circuit 6 to the negative polarity side of the battery 1. The lamp current IL is detected as a voltage by a current detecting resistor 8.

Figure 2:
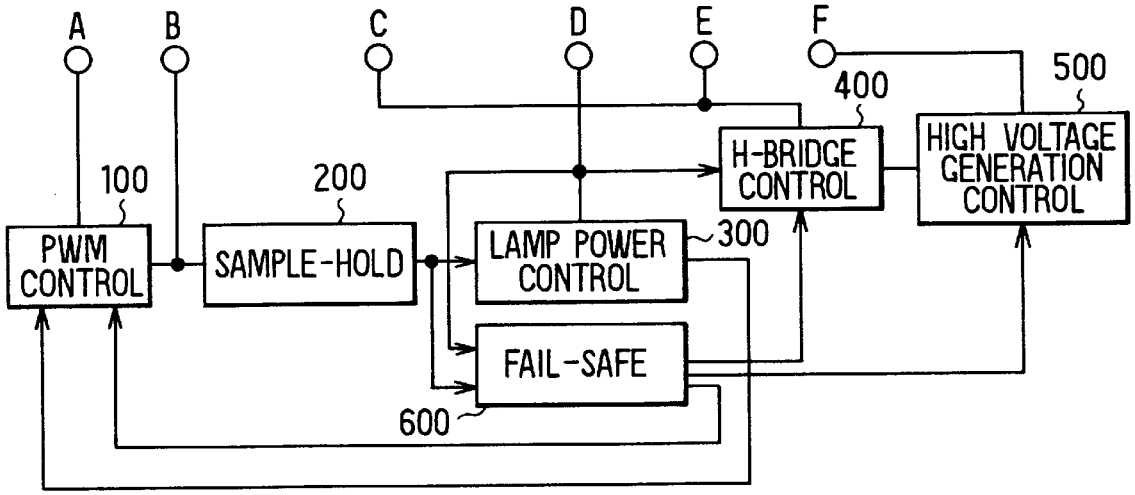
FIG. 2 is a block diagram showing a control circuit shown in FIG. 1.

A block diagram of the control circuit 10 is shown in FIG. 2. The control circuit 10 comprises a PWM control circuit 100 for turning on and off the MOS transistor 42 by a PWM signal, a sample-hold circuit 200 for sampling and holding the lamp voltage VL, a lamp power control circuit 300 for controlling the lamp electric power to a predetermined power based on the sample-held lamp voltage VL and the lamp current IL, a H-bridge control circuit 400 for controlling the H-bridge circuit 61, a high voltage generation control circuit 500 for generating the high voltage in the lamp 2 by turning on the thyristor 76, and a fail-safe circuit 600 for detecting abnormalities such as grounding of an electric wiring part 20 at both sides of the lamp 2 and effecting a fail-safe operation responsively.

The lighting operation of the discharge lamp apparatus as constructed above is described next.

When the lighting switch 3 turns on, electric power is supplied to each part of the apparatus. The PWM control circuit 100 PWM controls the MOS transistor 42. As a result, the voltage boosted from the battery voltage VB by the operation of the flyback transformer 41 is produced from the DC-DC converter 4. Further, the H-bridge control circuit 400 turns on and off alternately the MOS transistors 61*a*–61*d* diagonally in the H-bridge circuit 61. Thus, the high voltage produced from the DC-DC converter 4 is supplied to the capacitor 75 of the starting circuit 7 through the H-bridge circuit 61 to charge the capacitor 75.

The high voltage generation control circuit 500 produces a gate driving signal to the thyristor 76 to turn on the same based on signals produced from the H-bridge control circuit 400 indicative of the switching timing of the MOS transistors 61*a*–61*d*. When the thyristor 76 turns on, the capacitor 75 discharges to apply the high voltage to the lamp 2. As a result, the lamp 2 breaks down dielectrically and starts lighting.

The lamp 2 is driven by the a.c. voltage by switching the polarity of the discharge voltage (direction of discharge current) to the lamp 2 by the H-bridge circuit 61. Further, the lamp power control circuit 300 controls the lamp power to the predetermined power to light the lamp stably based on the lamp current IL and the lamp voltage VL (sampled and held by the sample-hold circuit 200).

The sample-hold circuit 200 masks transient voltages which are generated in synchronization with switching of the H-bridge circuit 61, and samples and holds the lamp voltage VL generated during the time other than the time of generation of the transient voltages.

Figure 3:
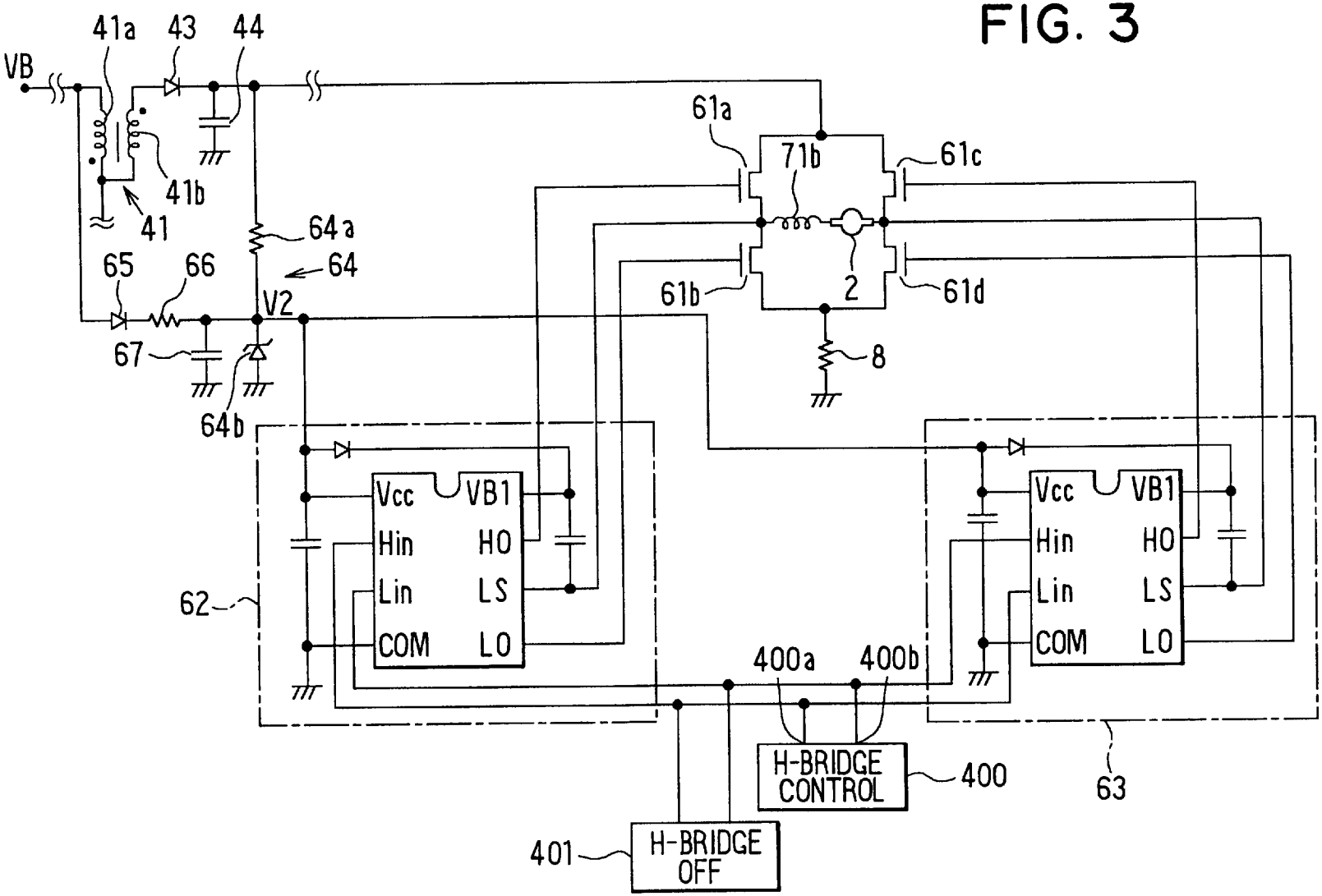
FIG. 3 is a detailed wiring diagram showing bridge driving circuits shown in FIG. 1.

The bridge driving circuits 62 and 63 are described next. Its detailed construction is shown in FIG. 3.

The bridge driving circuits 62 and 63 have the same construction, and use a high and low driver circuit (product number IR2101 of International rectifier, Inc. U.S.A). A signal of the terminal 400*a* of the H-bridge control circuit 400 is applied to the high voltage side input terminal Hin of the bridge driving circuit 62 and the low voltage side input terminal Lin. A signal of the terminal 400*b* of the H-bridge control circuit 400 is applied to the low voltage side input terminal Lin of the bridge driving circuit 62 and the high voltage side input terminal Hin of the bridge driving circuit 63. The signals of the H-bridge control circuit 400 are produced to change between the high level and the low level.

According to this construction, when the high level signal is produced from the terminal 400*a* of the H-bridge control circuit 400 and the low level signal is produced from the terminal 400*b* of the H-bridge control circuit 400, the MOS transistors 61*a* and 61*d* turn on and the MOS transistors 61*b* and 61*c* turn off in response to the output signals of the bridge driving circuits 62 and 63. Further, when the low level signal is produced from the terminal 400*a* of the H-bridge control circuit 400 and the high level signal is produced from the terminal 400*b* of the H-bridge control circuit 400, the MOS transistors 61*b* and 61*c* turn on and the MOS transistors 61*a* and 61*d* turn off in response to the output signals of the bridge driving circuits 62 and 63.

The bridge driving circuits 62 and 63 are connected to be supplied with a voltage from the secondary side of the flyback transformer 41. That is, a first electric power source circuit 64 comprising a resistor 64*a* and a Zener diode 64*b* is provided at the secondary side of the flyback transformer 41, so that a predetermined voltage V2 (for instance, 15V) generated by the first power circuit 64 is supplied to the bridge driving circuits 62 and 63. A primary side voltage (battery voltage VB) is also applied to the bridge driving circuits 62 and 63 through a diode 65, a resistor 66 and a noise filtering capacitor 67 in addition to the secondary side voltage of the transformer 41.

Further, a H-bridge off circuit 401 is provided to turn off all four MOS transistors 61*a*–61*d* of the H-bridge circuit 61 (off condition of the H-bridge circuit 61) by applying the low level signals to all input terminals Hin and Lin of the bridge driving circuits 62 and 63 in response to a signal from the fail-safe circuit 600.

Figure 4:
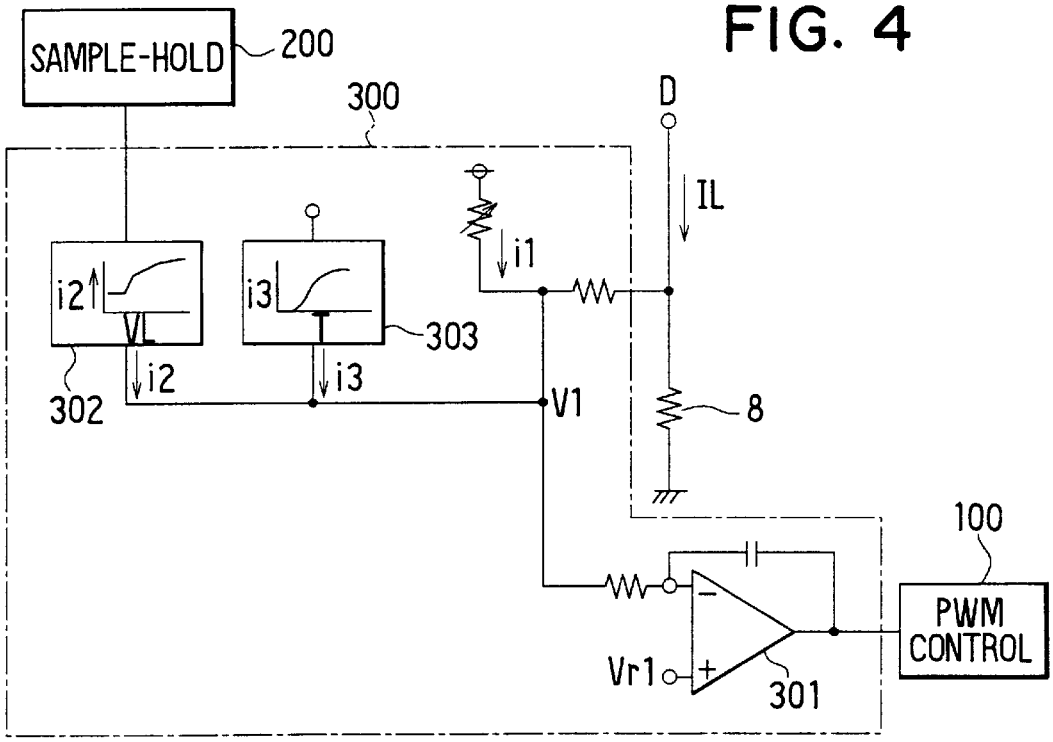
FIG. 4 is a detailed wiring diagram showing a lamp power control circuit shown in FIG. 2.

The above lamp power control circuit 300 is described next. Its detailed construction is shown in FIG. 4.

The lamp power control circuit 300 has an error amplifier circuit 301 for producing an output corresponding to the lamp voltage VL, the lamp current IL and the like, which are signals indicative of the lighting condition of the lamp 2. The output signal of the error amplifier circuit 301 is applied to the PWM control circuit 100. The PWM control circuit 100 increases the lamp electric power by increasing the duty ratio, which turns on and off the MOS transistor 42, as the output voltage of the error amplifier circuit 301 increases.

A reference voltage Vr1 is applied to a non-inverting input terminal of the error amplifier circuit 301 and a voltage V1 constituting a parameter for controlling the lamp power is applied to an inverting input terminal. Thereby, the error amplifier circuit 301 produces a voltage corresponding to a difference between the reference voltage Vr1 and the voltage V1.

The voltage V1 is determined based on the lamp current IL, constant current i1, current i2 set by a first current setting circuit 302 and current i3 set by a second current setting circuit 303. The sum of the current i1, current i2 and current i3 is set to be smaller than the lamp current IL.

Here, the first current setting circuit 302 sets the current i2 such that the current i2 increases as the lamp voltage VL increases as shown in the figure. The second current setting circuit 303 sets the current i3 such that the current i3 increases as a time period T after the turning on of the lighting switch 3 becomes longer as shown in the figure.

The lamp power control circuit 300 controls the lamp electric power by producing the voltage corresponding to the time T after the turning on of the lighting switch 3, the lamp voltage VL and the lamp current IL and the like. That is, the lamp power is increased to a high power (for instance, 75 W) at the time of starting lighting, gradually decreases the lamp power, and finally controls the lamp power to a fixed power (for instance, 35 W) when the lamp 2 is driven into the stable condition.

Figure 5:
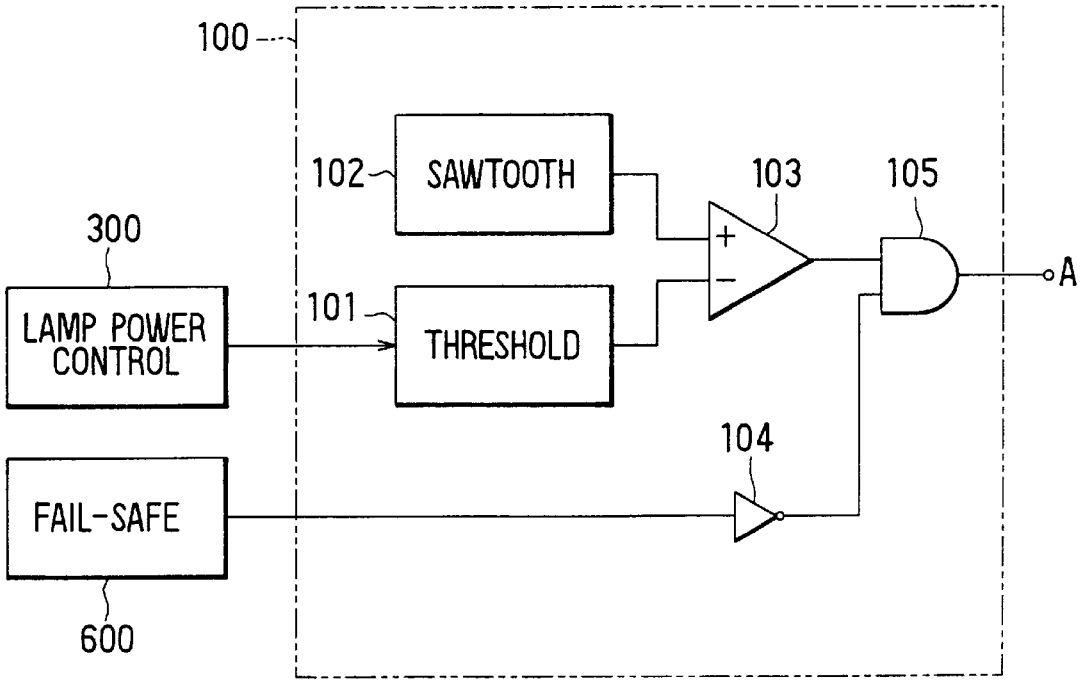
FIG. 5 is a detailed wiring diagram showing a PWM control circuit shown in FIG. 2.

The PWM control circuit 100 is described next. Its detailed construction is shown in FIG. 5.

The PWM control circuit 100 comprises a threshold level setting circuit 101 for setting a threshold level, a sawtooth wave forming circuit 102 for forming a sawtooth wave signal, a comparator for producing a gate signal having a duty ratio corresponding to the threshold level by comparing the sawtooth wave signal with the threshold level, and an AND gate 105 which receives the output signals from the comparator 13 and the fail-safe circuit 600.

The threshold level setting circuit 101 sets the threshold level in accordance with the output voltage (command signal) of the error amplifier circuit 301, that is, to a lower threshold level as the output voltage increases. Therefore, as the output voltage of the error amplifier circuit 301 increases to increase the lamp power, the threshold level decreases to increase the duty ratio. Further, as the output voltage of the error amplifier circuit 301 decreases to decrease the lamp power, the threshold level increases to decrease the duty ratio.

When the fail-safe circuit 600 produces a high level signal indicative of the grounded condition of the lamp 2, an inverter 104 produces a low level signal. The AND gate 105 produces a low level output to turn off the MOS transistor 42. Thus, when the lamp 2 is grounded, the DC-DC converter 4 stops its operation.

Figure 6:
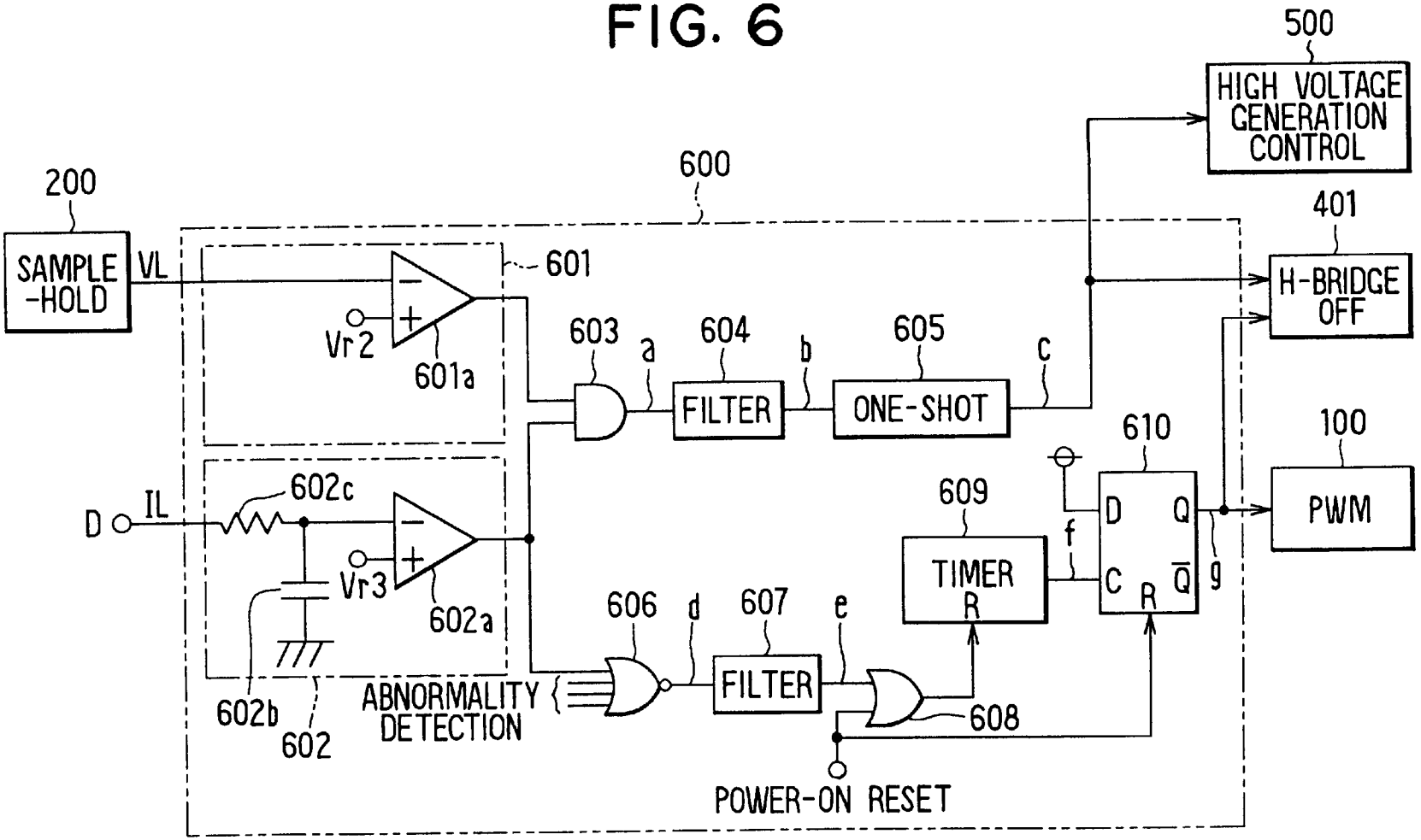
FIG. 6 is a detailed wiring diagram showing a fail-safe circuit shown in FIG. 2.

The fail-safe circuit 600 is described next. Its detailed construction is shown in FIG. 6.

The fail-safe circuit 600 comprises a lamp voltage detection circuit 601, a lamp current detection circuit 602, an AND gate 603, a filter 604, a one-shot multivibrator circuit 605, a NOR gate 606, a filter 607, a OR gate 608, a timer circuit 609 and a D-type flip-flop 610.

The lamp voltage detection circuit 601 has a comparator 601*a*, which compares the lamp voltage VL of the sample-hold circuit 200 and a predetermined voltage Vr2 (for instance, 20V) and produces a high level signal (voltage drop signal) while the lamp voltage VL is less than the predetermined voltage Vr2.

The lamp current detection circuit 602 comprises a comparator 602*a*, a capacitor 602*b* and a resistor 602*c*. The comparator 602*a* compares a voltage VIL corresponding to the lamp current IL with the predetermined voltage Vr3, and produces a high level signal (current drop signal) when the voltage VIL is less than the predetermined voltage Vr3, that is, the lamp current IL is less than a predetermined current (for instance, 0.2 A).

When the lamp 2 is under the power control, the lamp voltage VL is in the range of 20V–400V, for instance, and the lamp current is in the range of 0.35 A–2.6 A. Therefore, the lamp voltage detection circuit 601 and the lamp current detection circuit 602 both produce the low level signals.

However, when the electric wiring part at both sides of the lamp 2, that is, the electric wiring part between the inverter circuit 6 and the lamp 2, is grounded, an excessive current flows through the secondary side of the flyback transformer 41 and the lamp voltage VL is decreases to less than 20V. Further, the excessive current flows from the side of the secondary winding 41*b* to a ground, and the lamp current IL decreases to less than 0.2 A. Thus, the lamp voltage detection circuit 601 and the lamp current detection circuit 602 both produce the high level signals, and the AND gate 603 produces the high level output indicative of the grounded condition.

In case that the both sides of the lamp 2 is shorted, the lamp voltage VL decreases to less than the predetermined voltage Vr2 while the lamp current IL remains at more than the predetermined current. Further, in case that the lamp 2 is disconnected, the lamp current IL decreases to less than the predetermined current while the lamp voltage VL remains at more than the predetermined voltage Vr2. Thus, the grounded condition of the electric wiring part 20 can be distinguished from the shorting and disconnection of the lamp 2.

Figure 7:
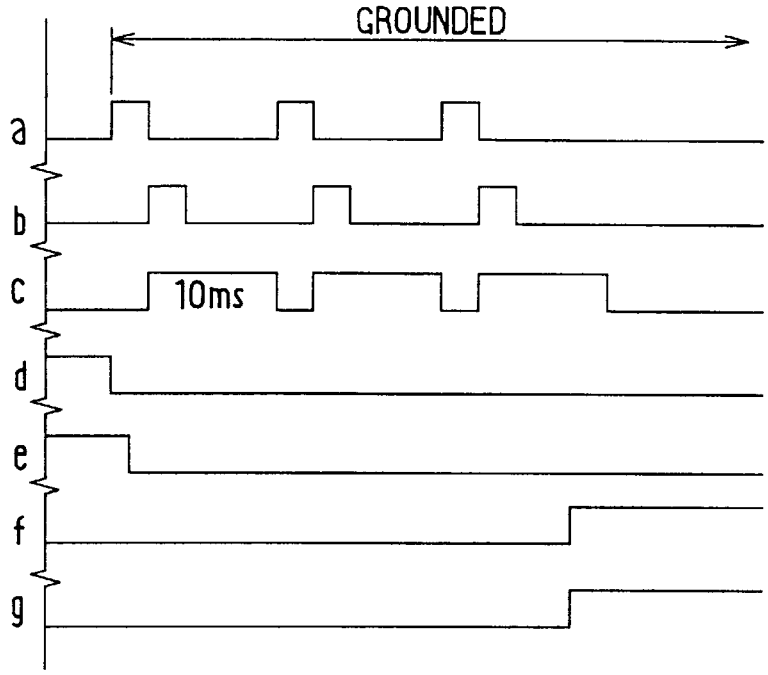
FIG. 7 is a signal waveform chart showing signal waveforms developed at various parts in FIG. 6.

The operation after the grounding is described next. Signals at various parts in FIG. 6 is shown in FIG. 7.

When the output signal "a" of the AND gate 603 changes to the high level signal, the output signal "b" of the filter 604 also changes to the high level. The output signal "c" of the one-shot multivibrator circuit 605 remains high for a predetermined period (10 ms, for instance), and this high level output signal is applied to the H-bridge off circuit 401 and the high voltage control circuit 500.

The H-bridge off circuit 401 turns off the H-bridge circuit 61 by the high level signal from the one-shot multivibrator circuit 605. Thus, the excessive current caused by the grounding of the electric wiring part 20 is interrupted by the MOS transistors 61*a* and 61*c*.

Figure 8:
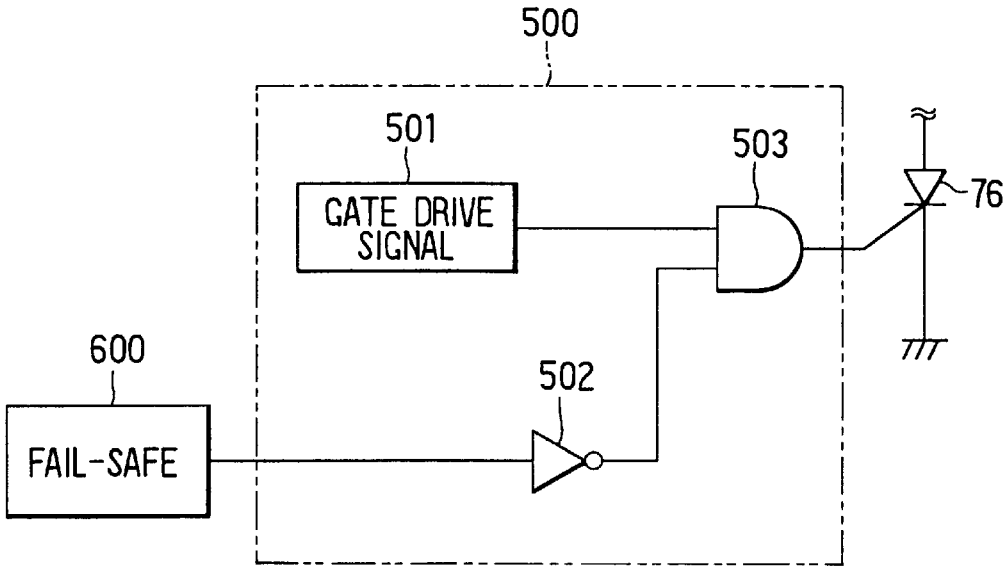
FIG. 8 is a wiring diagram showing a high voltage generation circuit shown in FIG. 2.

The high voltage control circuit 500 operates not to apply the gate driving signal to the thyristor 76 in response to the high level signal from the one-shot multivibrator circuit 605. The construction of the high voltage control circuit is shown in FIG. 8. The high voltage control circuit 500 has a signal generation circuit 501, which produces the gate driving signal to the thyristor 76 in response to the output signal from the H-bridge control circuit 400. Further, when the one-shot multivibrator circuit 605 produces the high level signal, the inverter 502 produces the low level output to close the AND gate 503 and disable the turning on of the thyristor 76. That is, generation of the high voltage for lighting the lamp 2 is disabled.

When the lamp voltage VL increases in response to the turning off of the H-bridge circuit 61, the output signal of the lamp voltage detection circuit 601 changes to the low level and the output signal "a" of the AND gate 603 changes to the low level.

When the output signal "c" of the one-shot multivibrator 605 changes to the low level thereafter, the H-bridge control circuit 400 starts to turn on and off the MOS transistors 61*a*–61*d* to start the electric power supply to the lamp 2. If the electric wiring part 20 continues to be in the grounded condition at this moment, the output signal of the lamp voltage detection circuit 601 changes to the high level again and the output signal "a" of the AND gate 603 also changes to the high level. As a result, the one-shot multivibrator circuit 605 produces the high level signal for the predetermined time to turn off the H-bridge circuit 61 and disable turning on of the thyristor 76.

The above operation is repeated as long as the grounding of the electric wiring part 20 continues.

Further, as the lamp current detection circuit 602 produces the high level signal, the output signal d of the NOR gate 606 changes to the low level and the output signal "e" of the filter 607 also changes to the low level. Further, as the output signal of the OR gate 608 changes to the low level, the timer circuit 609 is released from the reset condition and starts to time counting operation. When a predetermined time (for instance, 0.2 s) elapses and the output signal "f" of the timer circuit 609 changes to the high level, the Q-terminal output signal "g" of the D-type flip-flop 610 changes to a high level in response to the output signal "g" as a clock.

The H-bridge off circuit 401 turns off the H-bridge circuit 61 in response to the high level signal from the D-type flip-flop 610, and the PWM control circuit 100 turns off the MOS transistor 42. That is, when the D-type flip-flop 610 produces the high level signal, the outputs of the inverter 104 and the AND gate 105 in FIG. 5 change to the low level. The MOS transistor 42 turns off and the DC-DC converter 4 stops its operation.

Thus, the primary current is restricted to increase excessively. That is, if the MOS transistor 42 is not turned off under the condition that the electric wiring part 20 is grounded and a certain contact resistance exists at the contact part, the electric power of the secondary side of the flyback transformer 41 is consumed greatly. The lamp power control circuit 300 operates to turn on and off the MOS transistor 42 to increase the energy stored in the primary winding 41*a*. Thus, the excessive current tends to flow in the primary winding of the flyback transformer 41. By turning off the MOS transistor 42 to stop the operation of the DC-DC converter 4 as described above, the current flowing in the primary winding 41*a* of the flyback transformer 41 can be restricted from increasing excessively.

As described above, according to the present embodiment, it is determined that the grounding exists when the lamp voltage VL is less than the predetermined voltage and the lamp current IL is less than the predetermined current. The H-bridge circuit 61 is turned off temporarily (for the predetermined time) and the generation of the high voltage for lighting again is disabled. After the predetermined time, the H-bridge circuit 61 is operated again to enable lighting again. If the grounding is determined again in this operation, the above operation is repeated. In case that the repetition of this operation continues for the predetermined time period, the DC-DC converter 4 is stopped from operating and this stop is maintained.

Thus, as the stop and restart of the H-bridge circuit 61 are repeated in response to the determination of the grounded condition based on the lamp voltage VL and the lamp current IL and the fail-safe operation is effected when the repetition continues for the predetermined period, erroneous operation is prevented in comparison with the case in which the fail-safe operation is effected immediately in response to a single determination of the grounding.

It is to be noted in the fail-safe circuit 600 that the fail-safe operation is effected in response to not only the above grounding but also other abnormalities (for instance, disconnection of a connector of the lamp 2 not shown and the like). In this occasion, the abnormality detection signal (signal which changes to the high level at the time of abnormality detection) is applied to the NOR gate 606. If this abnormality detection signal continues while the timer circuit 609 measures the predetermined time period, the D-type flip-flop 610 produces the high level signal to turn off the H-bridge circuit 61 and the MOS transistor 42.

(Modification to Fail-safe Circuit)

In the above embodiment, the time periods which the timer circuit 609 measures, that is, the abnormality determination periods, are set to be equal to each other between the grounding detection and other abnormality detection. The abnormality determination periods are preferably long enough from the standpoint of preventing erroneous operation in abnormality detection. However, it is preferable that the fail-safe operation be effected as early as possible at the time of occurrence of grounding.

Therefore, in this modification, the abnormality determination period for the grounding detection is set to be shorter than that for the other abnormality detection.

Figure 9:
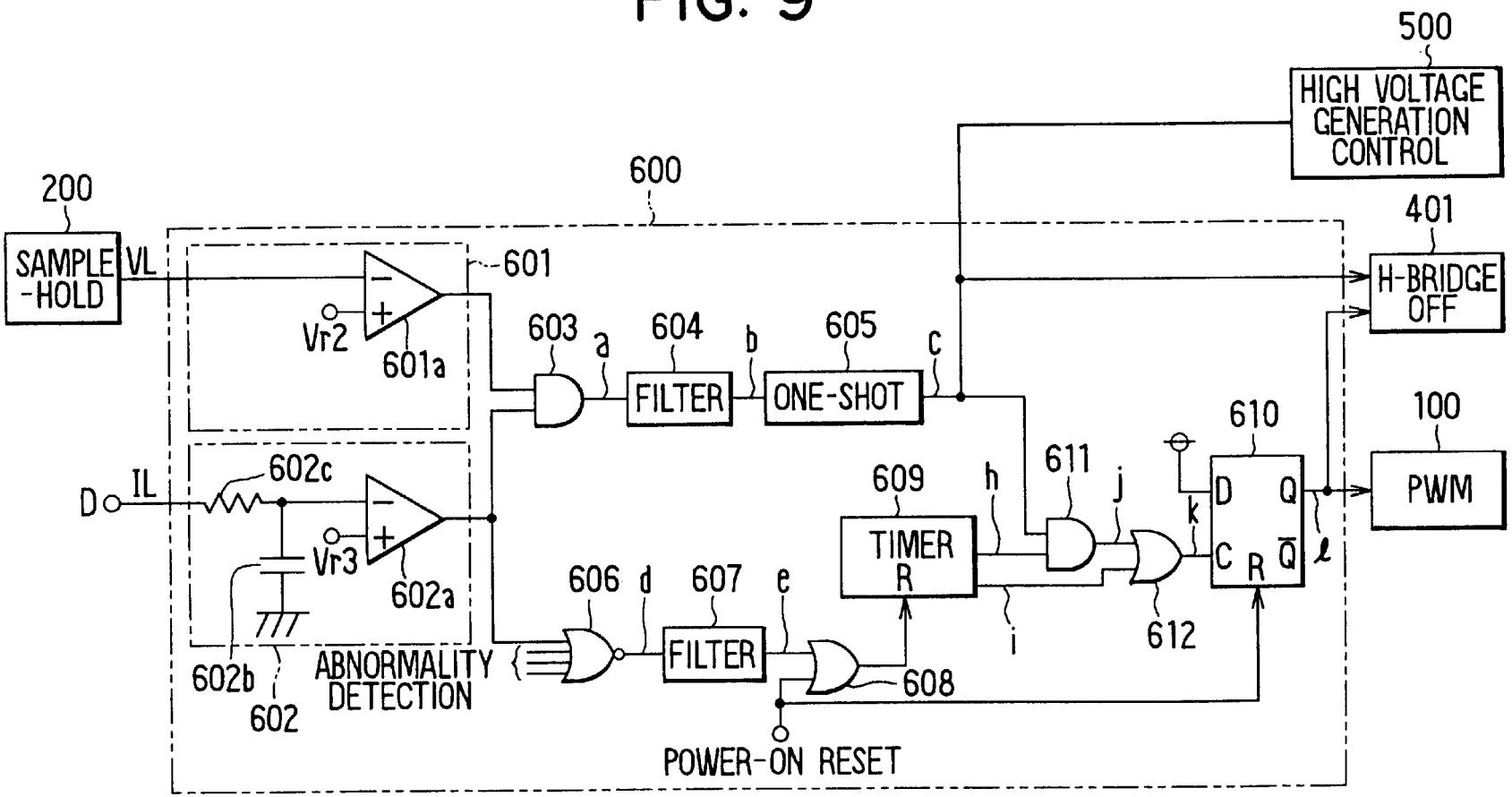
FIG. 9 is a detailed wiring diagram showing a modification of the fail-safe circuit shown in FIG. 6.
Figure 10:
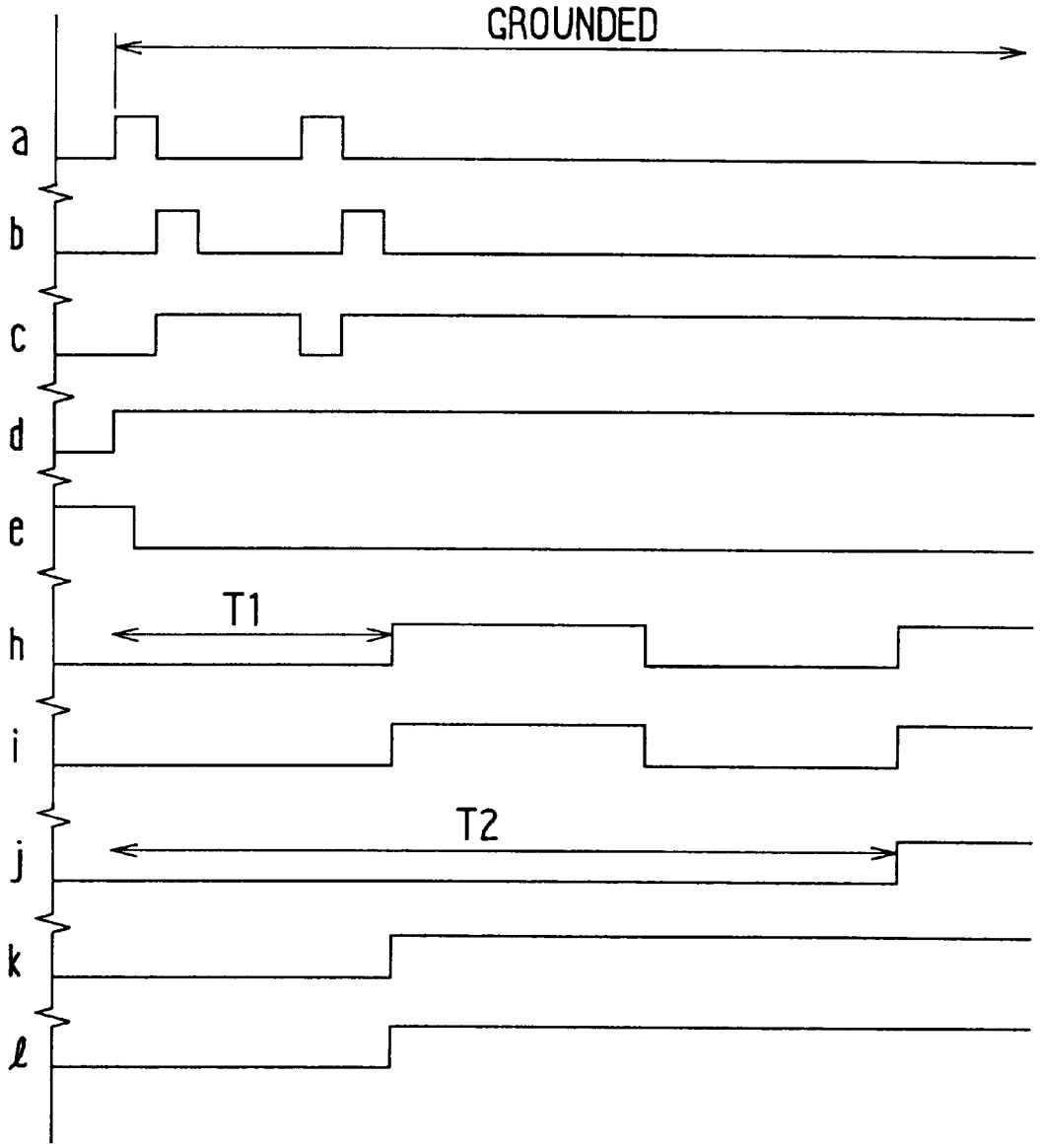
FIG. 10 is a signal waveform chart showing signal waveforms developed at various parts in FIG. 9.

The fail-safe circuit 600 according to this modification is shown in FIG. 9, and signal waveforms at various parts in FIG. 9 are shown in FIG. 10.

When the signal from the OR circuit 608 changes to the low level in response to the detection of grounding or other abnormalities, the timer circuit 609 is released from the reset condition and starts to measure the time. The timer circuit 609 changes the output signal "h" to the high level when a first predetermined time is measured, and changes the output signal "I" to the high level when a second predetermined time is measured.

In case of detection the grounding, when the output signal "h" of the timer circuit 609 and the output signal "c" of the one-shot multivibrator 605 both change to the high level, the output signal "j" of the AND gate 611 changes to the high level. As this high level signal is applied to the clock terminal of the D-type flip-flop 610 through the OR gate 612, the Q-terminal output signal "l" changes to the high level. Thus, the fail-safe operation is effected with the first predetermined time as the abnormality determination period in case of the detection of grounding.

In case of detection of the other abnormalities, the Q-terminal output signal "i" of the D-type flip-flop 610 changes to the high level when the output signal "i" of the timer circuit 609 changes to the high level. Thus, the fail-safe operation is effected at the time of detection of other abnormality by the use of the second abnormality determination period longer than that at the time of the detection of grounding.

In the above embodiment and modification, the fail-safe operation is effected when the stop and restart of the H-bridge circuit 61 continues for the predetermined time. However, the fail-safe operation may be effected by the use of the number of the stop and restart of the H-bridge circuit 61.

Figure 11:
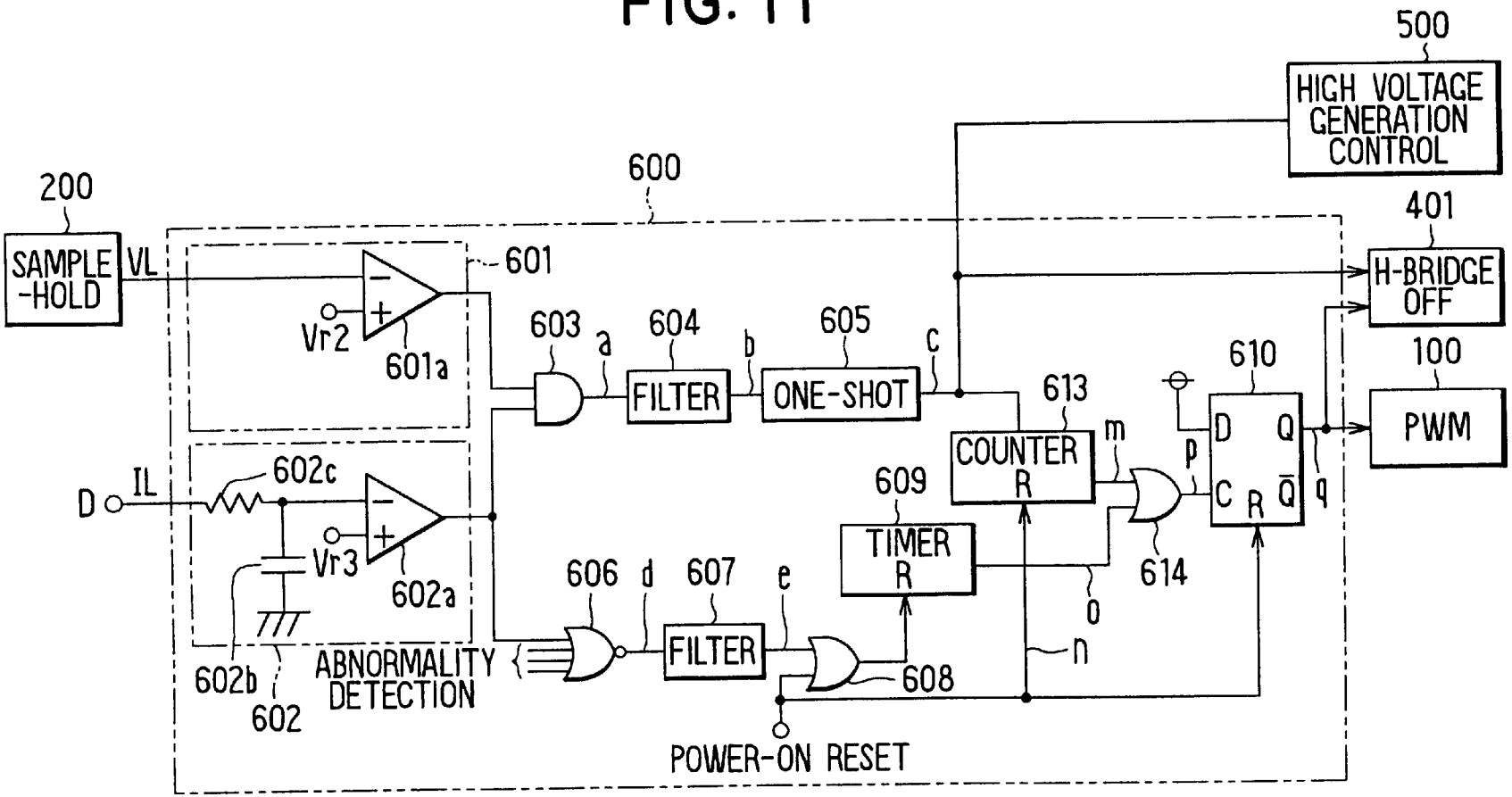
FIG. 11 is a detailed wiring diagram showing another modification of the fail-safe circuit shown in FIG. 6.
Figure 12:
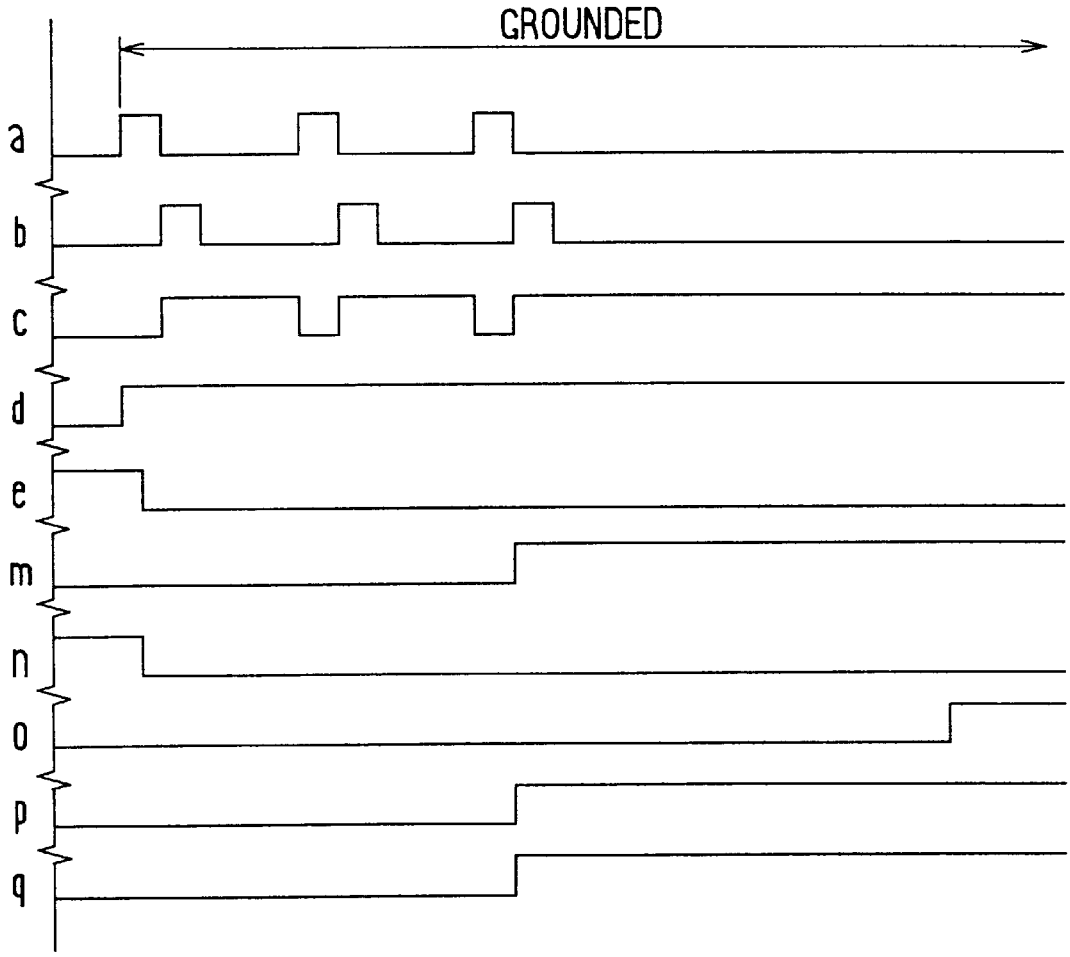
FIG. 12 is a signal waveform chart showing signal waveforms developed at various parts in FIG. 11.

A further modification of the fail-safe circuit 600 is shown in FIG. 11, and the signal waveforms at various parts in FIG. 11 are shown in FIG. 12.

In this modification, a counter circuit 613 is provided to count the number of the stop and restart of the H-bridge circuit 61 based on the output signal "c" of the one-shot multivibrator 605. The counter 613 changes the output signal "m" to the high level when its count reaches a predetermined number (for instance, 5). As the high level signal is applied to the clock terminal of the D-type flip-flop 610 through the OR gate 614, the fail-safe operation is effected similarly as in the above embodiment and its modification.

In this modification, similarly as in the embodiment, the fail-safe operation is effected also by the signal "o" of the timer circuit 609 when the predetermined time elapses. Thus, in this modification also, the fail-safe operation is effected at a timing when the number of the stop and restart of the H-bridge circuit 61 reaches the predetermined number or the time period measured by the timer circuit 609 reaches the predetermined time, whichever occurs first.

In this modification, however, the fail-safe operation may be effected only at the time the number of stop and restart of the H-bridge circuit 61 reaches the predetermined number.

(Second Embodiment)

This embodiment is differentiated from the first embodiment in the PWM control circuit 100 shown in FIG. 2, and may be implemented independently of the first embodiment or in combination with the feature of the fail-safe circuit 600 in the first embodiment. In this embodiment, the electronic unit is constructed similarly as shown in FIG. 1, to which reference is also made.

Figure 13:
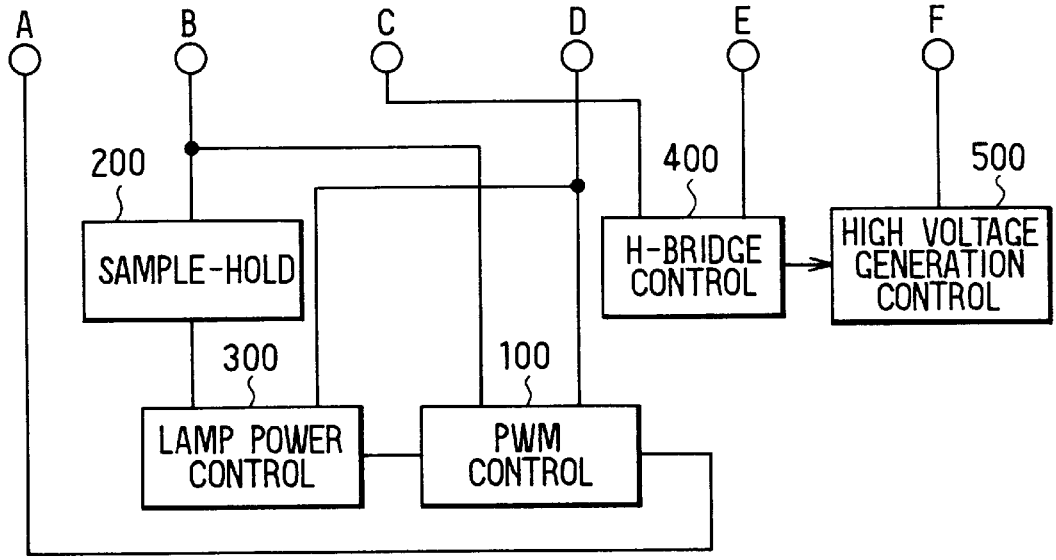
FIG. 13 is a block diagram showing a control circuit in a discharge lamp apparatus according to a second embodiment of the present invention.

As shown in FIG. 13, however, the control circuit 10 (FIG. 1) comprises the PWM control circuit 100 for turning on and off the MOS transistor 42 by the PWM signal, the sample-hold circuit 200 for sampling and holding the lamp voltage VL, the lamp power control circuit 300 for controlling the lamp electric power to a predetermined power based on the sample-held lamp voltage VL and the lamp current IL, the H-bridge control circuit 400 for controlling the H-bridge circuit 61, and the high voltage generation control circuit 500 for generating the high voltage in the lamp 2 by turning on the thyristor 76.

Figure 14:
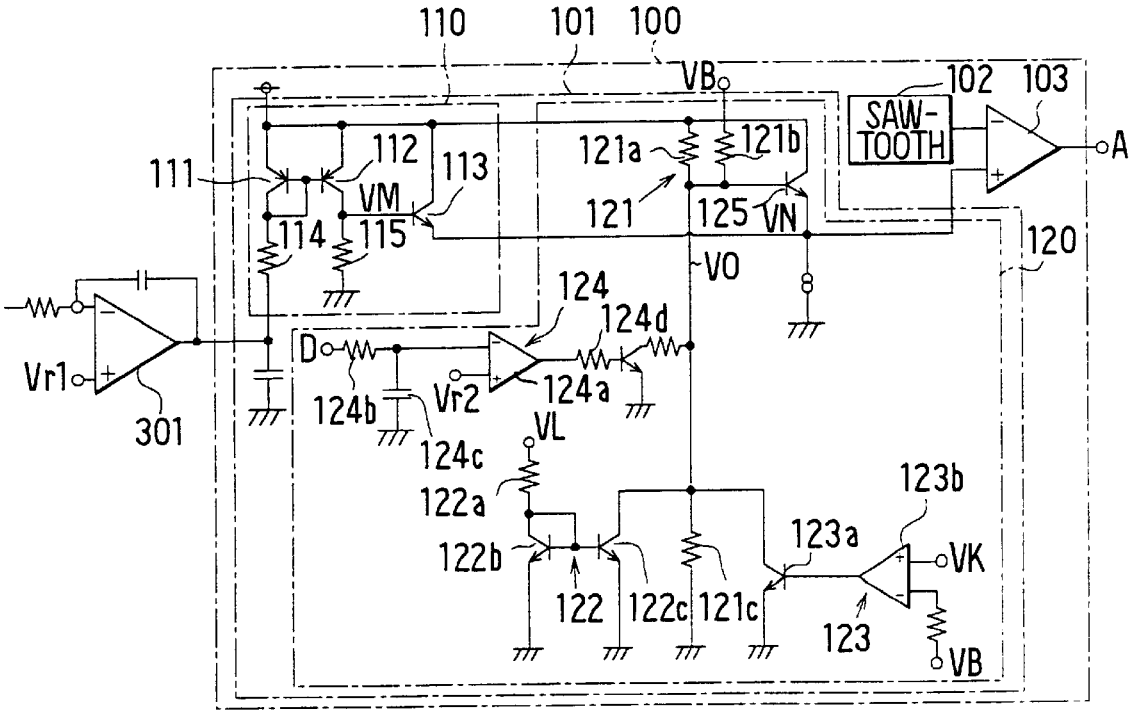
FIG. 14 is a detailed wiring diagram showing a lamp power control circuit shown in FIG. 13.

The PWM control circuit 100 is described next. Its detailed construction is shown in FIG. 14.

The PWM control circuit 100 comprises a threshold level setting circuit 101 for setting a threshold level, a sawtooth wave forming circuit 102 for forming a sawtooth wave signal, and a comparator 103 for producing a gate signal having a duty ratio corresponding to the threshold level to the MOS transistor 42 by comparing the sawtooth wave signal with the threshold level.

The threshold level setting circuit 101 is for setting the threshold level in accordance with the output voltage (command signal) of the error amplifier circuit 301. It includes a level inversion circuit 110 for setting the threshold level which decreases as the output voltage increases, and a limit setting circuit 120 for setting an upper limit (limit value) of the duty ratio.

The level inversion circuit 110 comprises PNP transistors 111 and 112 forming a current mirror circuit, a NPN transistor 113 the base terminal of which is connected to the collector terminal of the PNP transistor 112, and resistors 114 and 115. The output terminal of the error amplifier circuit 301 is connected to the collector terminal of the PNP transistor 111 through the resistor 114. The emitter terminals of the PNP transistors 111 and 112 are connected to a constant voltage source.

When the output voltage of the error amplifier circuit 301 decreases to decrease the lamp power, the current flowing in the resistor 114 increases. As a result, the collector current of the PNP transistor 112 is increased by the PNP transistors 111 and 112 forming the current mirror circuit, and the voltage VM at the junction between the collector terminal of the PNP transistor 112 and the resistor 115 is increased. As this voltage VM is applied as the input voltage VN to the inverting input terminal of the comparator through the transistor 113 forming an emitter follower circuit, the input voltage VN increases and the threshold level increases to decrease the duty ratio.

When the output voltage of the error amplifier circuit 301 increases to increase the lamp power, the collector current of the PNP transistor 112 is decreased, and the voltage VM is increased. As this voltage VM decreases, the input voltage VN decreases and the threshold level decreases to increase the duty ratio.

The limit setting circuit 120 for setting the upper limit of the duty ratio is described next. The limit setting circuit 120 comprises a first limit setting circuit 121 for setting a limit value based on the battery voltage VB, a second limit setting circuit 122 for setting a limit value based on the lamp voltage VL, a third limit setting circuit 123 for setting a limit value to a maximum value which is possible in designing the circuit when the battery voltage VB decreases to less than a predetermined voltage, a fourth limit setting circuit 124 for setting a limit value based on the lamp current IL, and a NPN transistor 125 for limiting the duty ratio to the limit value set by the limit setting circuits 121–124.

The limit setting circuit 121 comprises resistors 121*a*–121*c*, and provides a voltage V0 by dividing, by the resistors 121*a*–121*c*, the battery voltage VB developed at the junction between the vehicle-mounted battery 1 and the primary winding 41*a* of the flyback transformer 41.

This voltage Vo is used to limit the duty ratio. It is assumed here that the output voltage of the error amplifier 301 increases to increase the lamp power and the voltage VM decreases. When the voltage VM is higher than the voltage V0 at this time, the NPN transistor 125 turns off and the input voltage VN to the comparator 103 is set by the voltage VM. Thus, the threshold level is set based on the output voltage of the error amplifier circuit 301. When the voltage VM decreases to less than the voltage V0 to increase the lamp power, the NPN transistor 125 turns on and the input voltage VN is limited to the voltage V0. That is, the threshold level is limited by this voltage V0 not to exceed it. The voltage V0 corresponds to the above limit. As the voltage V0 decreases, the limit increases, that is, the maximum duty ratio increases.

Figure 16:
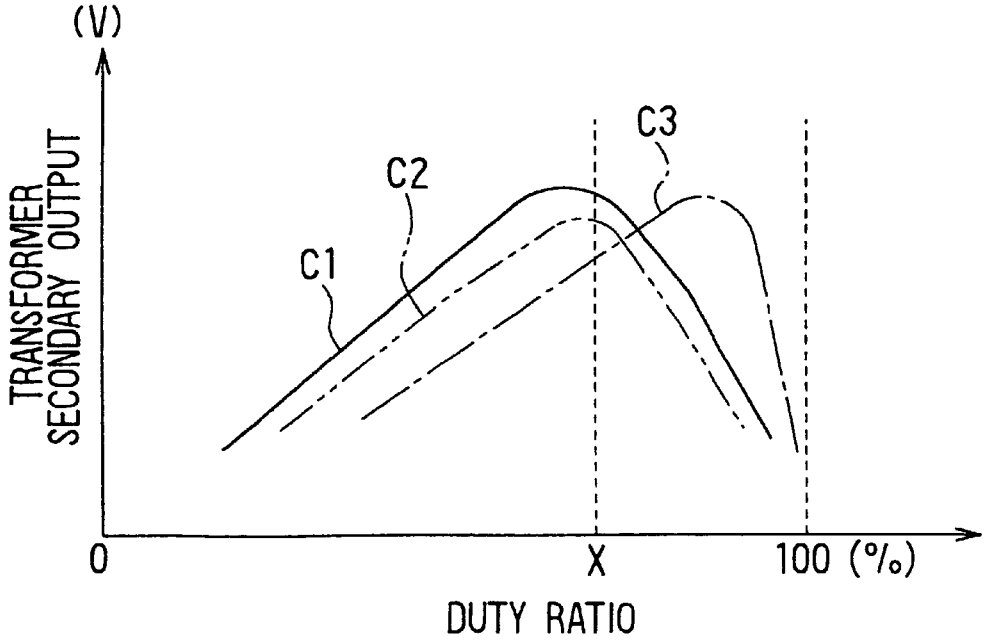
FIG. 16 is a characteristics graph showing a relation between a secondary side output of a transformer and a duty ratio.

In the first limit setting circuit 121, the voltage V0 is decreased as the battery voltage VB decreases. This is for the purpose that, as shown in FIG. 16, because the characteristics C1 shifts slightly to the right side and the height of the peak decreases as shown by the characteristics C2 as the battery voltage VB decreases, the characteristics is matched to the characteristics C2.

The second limit setting circuit 122 has a resistor 122*a* and NPN transistors 122*b* and 122*c* forming a current mirror circuit, so that the voltage V0 is varied in accordance with the lamp voltage VL indicative of the power supplied to the lamp 2. That is, as the lamp voltage VL increases, the collector current of the NPN transistor 122*c* forming the current mirror circuit increases to decrease the voltage V0 and increase the limit value. This is for the purpose that, because the characteristics C1 shifts to the right side as shown by the characteristics C3 in FIG. 6 as the power supplied to the lamp 2 increases, the characteristics is matched to the characteristics C3.

The above limit is set to enable supply of the sufficient energy to the secondary side of the flyback transformer 41. That is, this limit is provided for the purpose of preventing the secondary side output of the transformer 41 from decreasing oppositely, when the lamp power control circuit 300 operates to increase the duty ratio so that the lamp power in increased greatly.

However, when the battery voltage VB decreases greatly to less than 7V, for instance, the above limit is not appropriate and hence the limit value should be increased more. That is, as the secondary side output of the flyback transformer 41 decreases greatly when the battery voltage VB decreases more greatly, sufficient secondary side output can not be provided unless the above limit is increased correspondingly.

Therefore, the limit value is set to a maximum value which is possible in designing the circuit by the third limit setting circuit. This third limit setting circuit 123 comprises a NPN transistor 123*a* and a comparator 123*b* for turning on and off the NPN transistor 123*a*.

The comparator 123*b* is applied with a predetermined voltage (for instance, 7V) VK at its noninverting input terminal and with the battery voltage VB at its inverting input terminal. When the battery voltage VB decreases to less than the voltage VK, the NPN transistor 123*a* turns on and the voltage V0 is reduced to about 0V. As a result, the limit is increased to a value which is capable of increasing the duty ratio to about 100%, so that the sufficient secondary side output can be provided.

The fourth limit setting circuit 124 is provided to improve the lighting characteristics at the time of starting lighting the lamp. This fourth limit setting circuit 124 is for increasing the limit value when the lamp current IL is less than a predetermined value. It comprises a comparator 124*a*, a filter circuit including a resistor 124*b* and a capacitor 124*c*, a NPN transistor 124*d*, and the like.

The comparator 124*a* compares the voltage applied from the terminal D through the filter circuit, that is, the voltage corresponding to the lamp current IL, with a reference voltage Vr2. It produces a high level signal to turn on the NPN transistor 124*d*, when the voltage corresponding to the lamp current IL is less than the reference voltage Vr2. As a result, the voltage V0 is decreased and the limit value is increased, so that the secondary side output of the flyback transformer 41 can be increased sufficiently.

Thus, as a result, the secondary side output of the flyback transformer 41 can be increased sufficiently and the lighting characteristics of the lamp 2 can be improved, by increasing the limit value when the lamp current IL is less than the predetermined value.

As the lamp current does not flow before the lamp 2 lights immediately after the turning on of the lighting switch 3, the limit value is increased by the above operation. Thus, it is advantageous that the secondary side output of the flyback transformer 41, that is, the lamp voltage VL, can be boosted at an earlier time.

In the above embodiment, the fourth limit setting circuit 124 is designed to increase the limit value when the lamp current IL is less than the predetermined value. The limit value may be varied continuously in accordance with the lamp current. This detailed construction is shown in FIG. 15.

Figure 15:
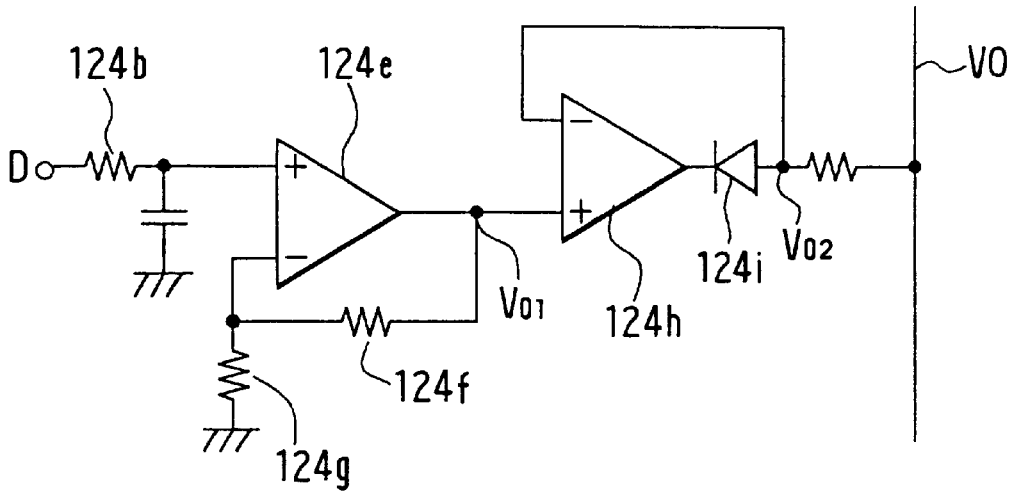
FIG. 15 is a detailed wiring diagram showing a modification of a fourth limit setting circuit shown in FIG. 14.

In FIG. 15, the voltage corresponding to the lamp current IL is applied to the noninverting input terminal of an operational amplifier 124*e* from the terminal D though a filter circuit. This voltage is amplified with a gain determined by resistors 124*f* and 124*g* and produced as a voltage $V_{01}$. When the voltage V0 is more than the voltage $V_{01}$, the output voltage $V_{02}$ is equalized to the voltage $V_{01}$ to decrease the voltage and increase the limit. In this instance, the limit value can be increased as the lamp current IL decreases.

(Third Embodiment)

This embodiment is directed to an installation of the electronic unit and the lamp 2 used, for instance, in the first embodiment and the second embodiment.

Figure 17:
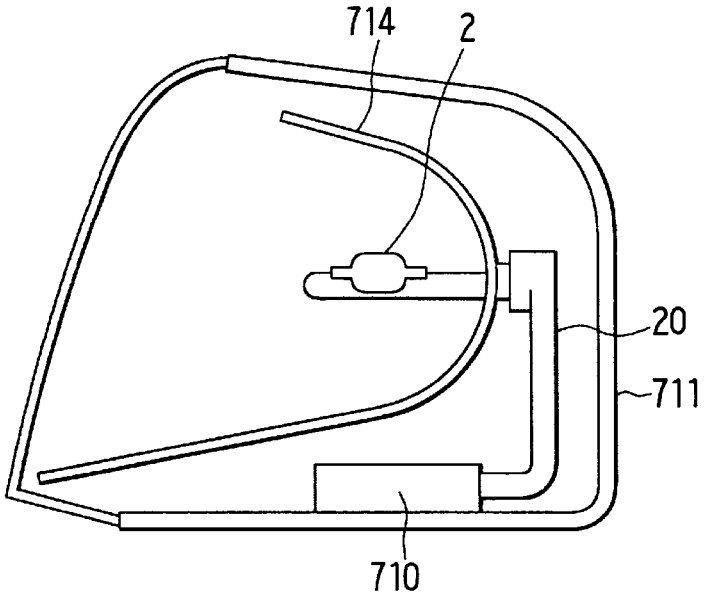
FIG. 17 is a schematic side view showing a mounting position of a ballast casing according to a third embodiment of the present invention.

As shown in FIG. 17, it is preferred to encase the electronic unit (FIG. 1) in a ballast casing 710 and dispose the ballast casing 710 within a housing 711 of a vehicle front light. In this instance, the ballast casing 710 is positioned underneath a reflector 714, and therefore need be sized thin to adapt in a limited space between the reflector 714 and the housing 711.

However, if the ballast casing 710 is sized thin, there arises a disadvantage that the performance of the starter transformer 71 encased in the ballast casing 710 is lessened. That is, the leakage magnetic flux increases with the result of lessening of performance, if the ballast casing 710 is sized thin, because the starter transformer 71 is a closed magnetic circuit type and the ballast casing 710 is made of a conductive material such as aluminum to shield electromagnetic wave.

Figure 18A:
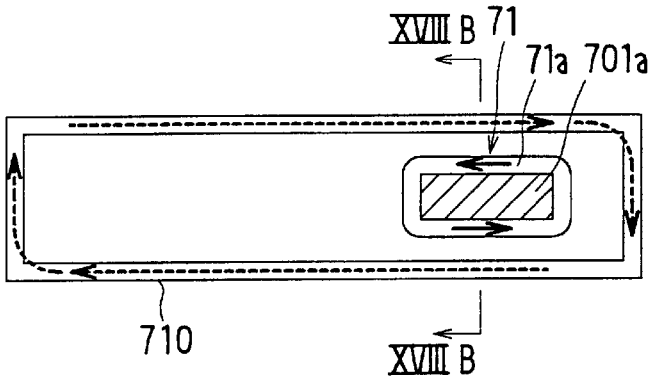
FIGS. 18A and 18B are sectional views showing a starter transformer encased within the ballast casing.
Figure 18B:
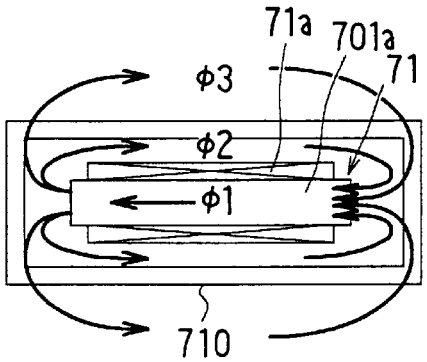

If the starter transformer 71 is an open magnetic circuit type in which the primary coil 71*a* and the secondary coil 71*b* (not shown) is wound around a core 701*a* as shown in FIG. 18A, electric current flows though the coil 71*a* in a direction indicated by a solid arrow. At this moment, the magnetic flux is formed in arrow directions shown in FIG. 18B by the primary coil 71*a*. Thus, $\phi 1=\phi 2+\phi 3$ holds, in which $\phi 1$ indicates the effective magnetic flux in the coil portion, $\phi 2$ indicates the magnetic flux in the ballast casing 710, and $\phi 3$ indicates the magnetic flux leaking to the outside of the ballast casing 710.

In this case, the total magnetic flux in the ballast casing 710 is $\phi 1-\phi 2$ ($=\phi 3$). An eddy current flows through the ballast casing 710, which is a conductive body, in a direction to cancel $\phi 1-\phi 2$ (arrow direction indicated by a dotted line in FIG. 18A). Therefore, the effective magnetic flux in the starter transformer 71 is about ($\phi 1-\phi 3$), and the performance is lessened in accordance with the amount of magnetic flux leaking to the outside of the ballast casing 710. In this instance, it becomes necessary to add a primary voltage boosting circuit, increase a capacitance of a charging capacitor, resulting in increased cost for ensuring the performance.

The lessening of performance may be overcome by the use of the starter transformer 71, which is a closed magnetic circuit type, because the ratio of the above magnetic flux $\phi 3$ can be decreased.

Even the closed magnetic circuit type, however, has the gap in the closed magnetic circuit core to restrict magnetic saturation. Thus, it is still likely that the performance is lessened by the leakage magnetic flux at the gap portion.

Figure 19A:
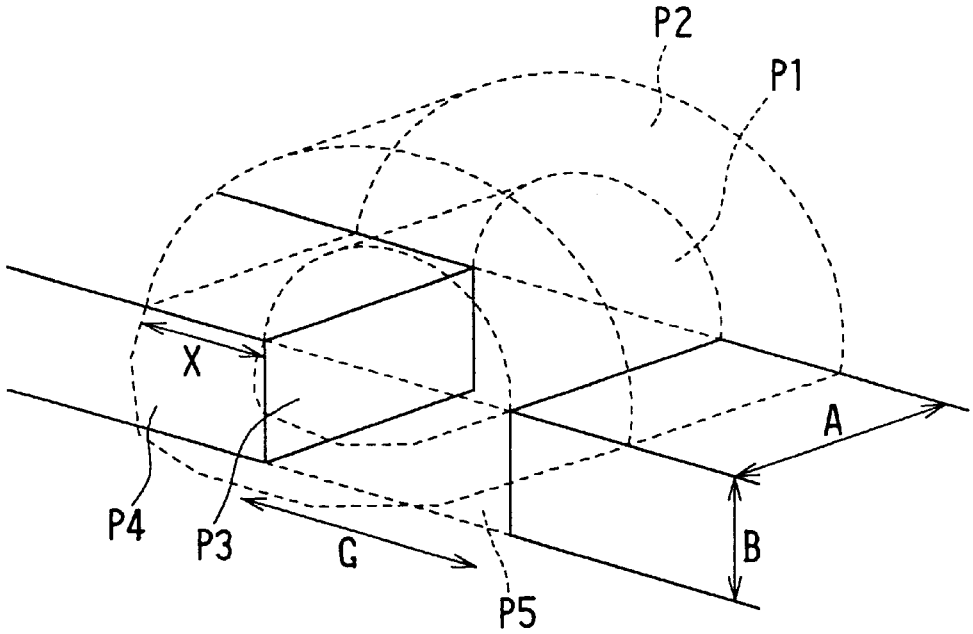
FIGS. 19A and 19B are explanatory views for evaluating a leakage flux at a gap portion of a closed magnetic circuit core.
Figure 19B:
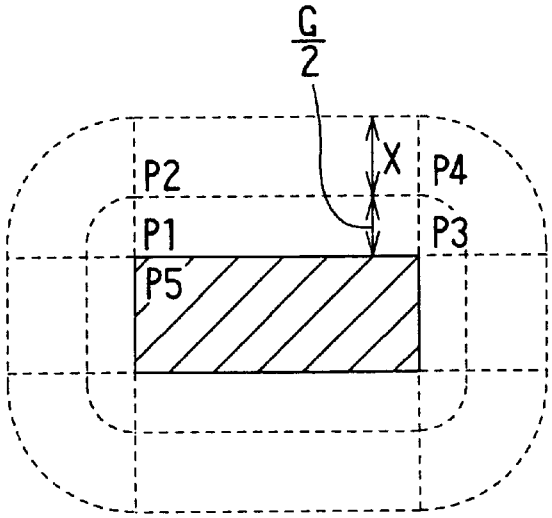

As a method for calculating the magnetic circuit at the gap portion, Roters permeance equation which is restricted to a simple geometric shape. The magnetic circuit at the gap portion is considered to be divided into five locations as shown in FIGS. 19A and 19B, which show perspectively and cross sectionally, respectively. Each permeance P1 to P5 of the magnetic circuits is expressed by the following equation 1 to equation 5. Here, P1 is a permeance of the magnetic circuit of a semi-cylindrical part, P2 is a permeance of a the magnetic circuit of a semi-hollow cylindrical part, P3 is a permeance of the magnetic circuit of one quarter sphere, P4 is a permeance of the magnetic circuit of a shell of the one quarter sphere, and P5 is a permeance of the magnetic circuit at opposing parts.

$$P1=2\cdot 0.26\cdot\mu_0\cdot(A+B) \quad \text{[Equation 1]}$$

$$P2=2\cdot\mu_0\cdot(A+B)/\pi\ln(1+2\cdot X/G) \quad \text{[Equation 2]}$$

$$P3=4\cdot 0.077\cdot\mu_0\cdot G \quad \text{[Equation 3]}$$

$$P4=\mu_0\cdot X \quad \text{[Equation 4]}$$

$$P5=\mu_0\cdot A\cdot B/G \quad \text{[Equation 5]}$$

The ratios of the magnetic flux passing through the magnetic circuits are proportional to the ratios of the permeance, as long as the magnetic circuits are in series.

In case that the ballast casing 710 is sized thin, the parts P2 and P4, which are located as the outermost shells, pass though the outside of the ballast casing 710. Thus, the lessening of performance can be estimated by the ratio of magnetic flux. In this instance, although the estimation of the lessening of performance is influenced by X, X is set to a maximum, 20 mm, with which the influence of leakage magnetic flux arises. Further, as the magnitude G of the gap increases, the magnetic flux at the P1 part and the P3 part become the leakage magnetic flux, resulting in further lessening of performance. By setting G>> A, B, the lessening of performance saturates and the lessening of performance in the open magnetic circuit can be estimated.

Figure 20A:
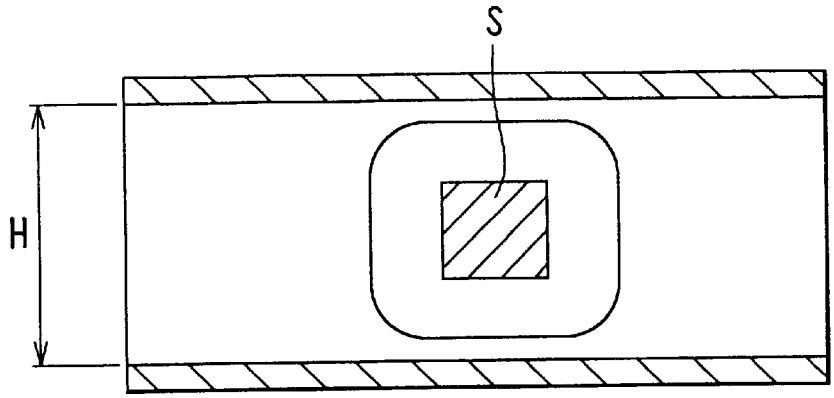
FIGS. 20A and 20B are explanatory views showing a relation between a core cross sectional area and a ballast casing inside height.

Based on the evaluation of the leakage magnetic flux at the gap portion, the lessening of performance relation between the cross sectional area S ($mm^2$) of the core and the inside height H (mm) of the ballast casing 710 is analyzed. Here, the core sectional area S and the ballast casing inside height H is shown in FIG. 20A. In case that the core sectional area S is held unchanged, the performance lessens more as the ballast casing inside height H decreases. Oppositely, in case that the ballast casing inside height H is held unchanged, the performance lessens more as the core sectional area S increases.

Figure 20B:
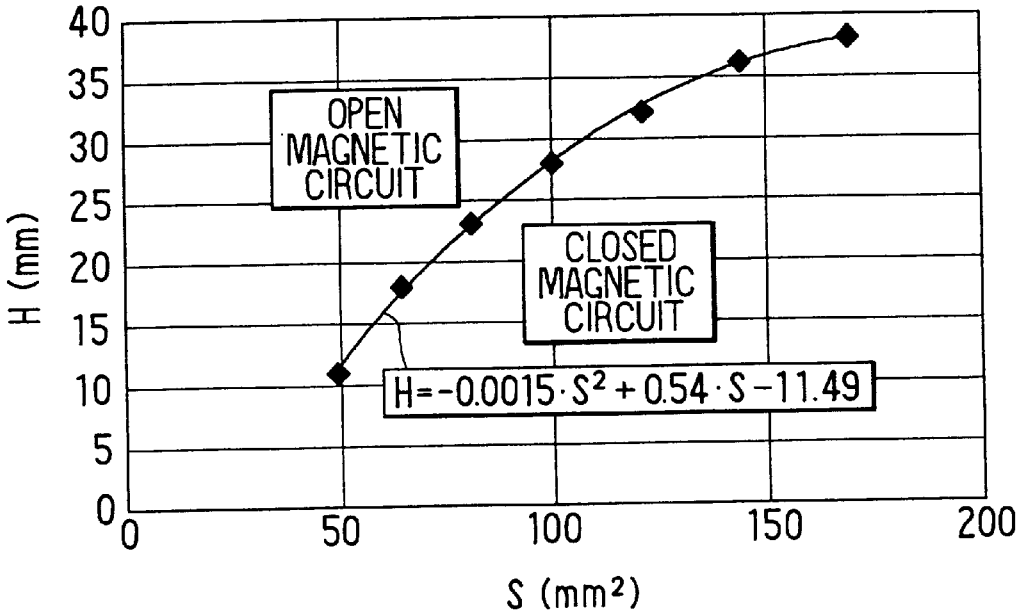
Figure 21A:
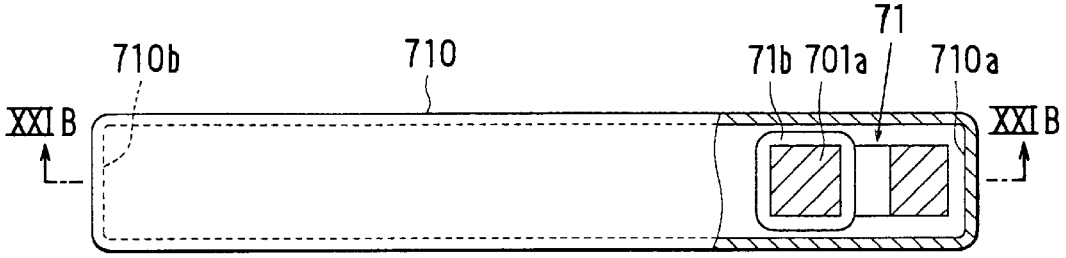
FIGS. 21A and 21B are partial cross sectional views showing the starter transformer in the ballast casing shown in FIG. 17.
Figure 21B:
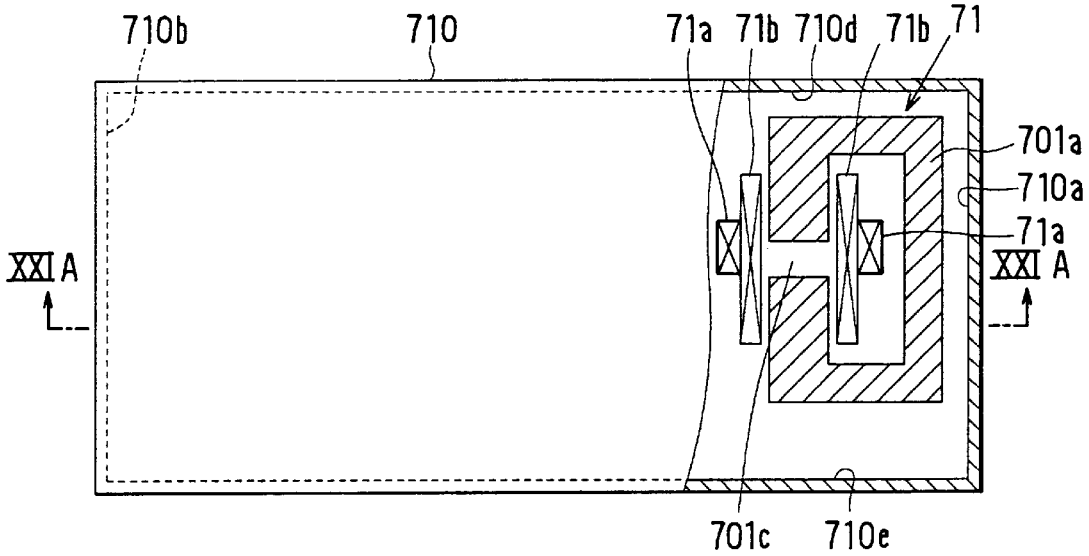

The boundary between the core sectional area S and the ballast casing inside height H which causes 10% performance decrease by the leakage magnetic flux is shown in FIG. 20B, with respect to a case in which G is sufficiently large, that is, the magnetic circuit is in substantially the open type. This boundary is expressed as $H=-0.015\cdot S^2+0.54\cdot S-11.49$. The open magnetic circuit type has a large lessening of performance at the lower part in the boundary. That is, the performance can not be ensured, unless the closed magnetic circuit type is used. Therefore, specifically, the third embodiment using the closed magnetic circuit core is constructed as shown in FIGS. 21A and 21B.

In this embodiment, the ballast casing 710 made of aluminum is disposed within the housing 711 of the front light as shown in FIG. 17. various electrical component parts for lighting the lamp 2 is encased within the ballast casing 710, although only the starter transformer 71 is shown.

The starter transformer 71 1 is constructed by the closed magnetic circuit core 701*a* and the primary coil 71*a* and the secondary 71*b*. Although shown in FIG. 21B but not in FIG. 21A, the primary coil 71*a* of the starter transformer 71 is wound around the secondary coil 71*b*. The closed magnetic circuit core 701*a* is provided with a gap 1*c*. The closed magnetic circuit core 701*a* has across sectional area S of about 120 $mm^2$, and the ballast casing 710 has an inside height H of about 17 mm. In this instance, as the core cross sectional area S and the ballast casing inside height H satisfy the relation, that is, $H\leqq -0.0015\cdot S^2+0.54\cdot S-11.49$, the starter transformer 71 should be the closed magnetic circuit type to provide a sufficient performance.

Further, as the starter transformer 71 constitutes a high voltage part, it is disposed at a dislocated position which is a longitudinal end part in the ballast casing 710, that is, one side in the ballast casing 710 which is in a rectangular parallelopiped shape in a longitudinal direction (that is, at the side of a side wall 701*a* of both side walls 710*a* and 710*b* opposing each other in the ballast casing 710).

Here, the gap 1*c* is provided at a location, which is the other side (that is, at the side of the other side wall 710*b*) in the ballast casing 710 in the longitudinal direction. Thus, crossing of the leakage magnetic flux at the gap 1*c* with the ballast casing 710 can be restricted to reduce the lessening of performance.

Figure 22:
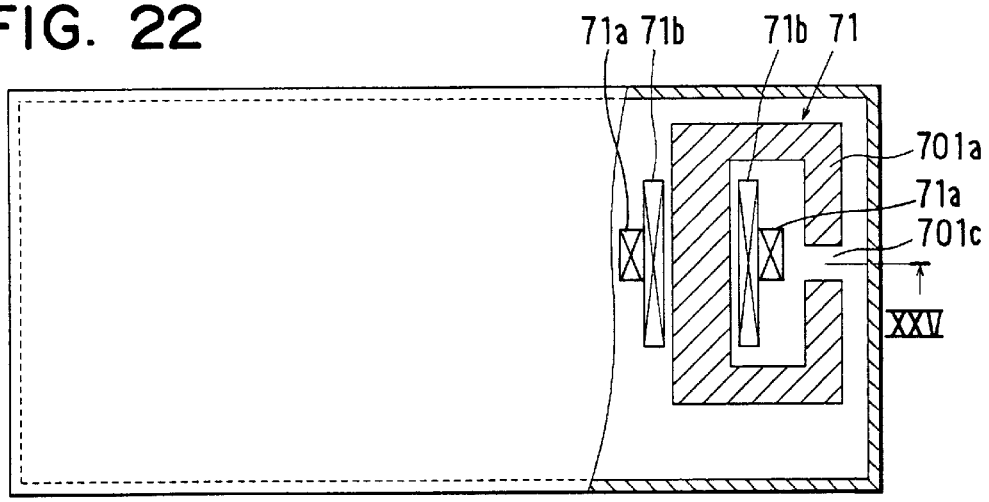
FIG. 22 is a partial cross sectional view showing an example in which a gap of a closed magnetic circuit core is provided at an end side in the ballast casing.
Figure 23:
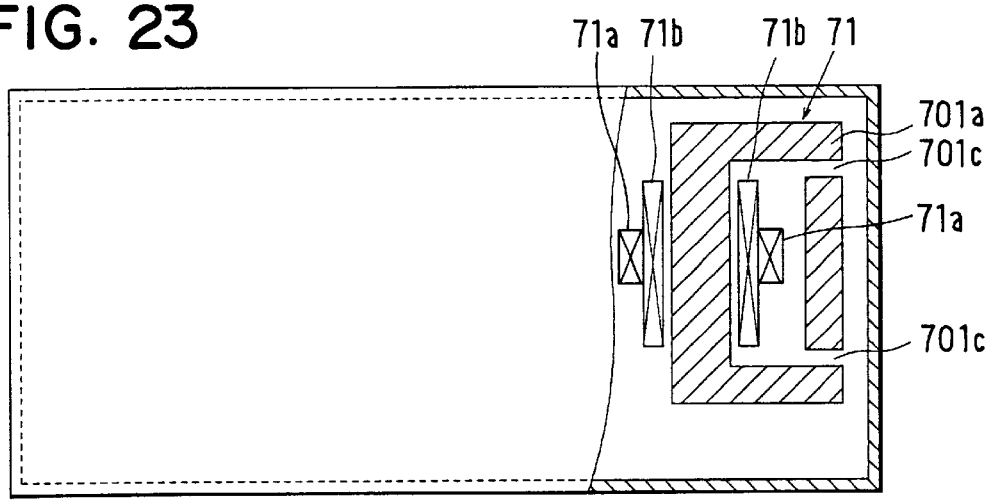
FIG. 23 is a partial cross sectional view showing another example in which the gap of the closed magnetic circuit core is provided at the end side in the ballast casing.

In positioning the starter transformer 71 at the end part in the ballast casing 710, it is considered that the gap 701*c* of the closed magnetic circuit core 701*a* is provided at the end part side in the ballast casing 710 as shown in FIGS. 22 and 23. In this case, however, as the leakage flux at the gap 1*c* crosses the ballast casing 710, the performance lessens. As opposed to this, in case that the gap 701*c* of the closed magnetic circuit core 701*a* is provided at the side of the central part in the ballast casing 710 as shown in FIGS. 21A and 21B, the gap 701*c* is positioned away from the side walls 710*a* and 710*b*. The crossing of the leakage magnetic flux at the gap 701*c* crosses less with the ballast casing 710, thereby reducing lessening of performance.

Figure 24:
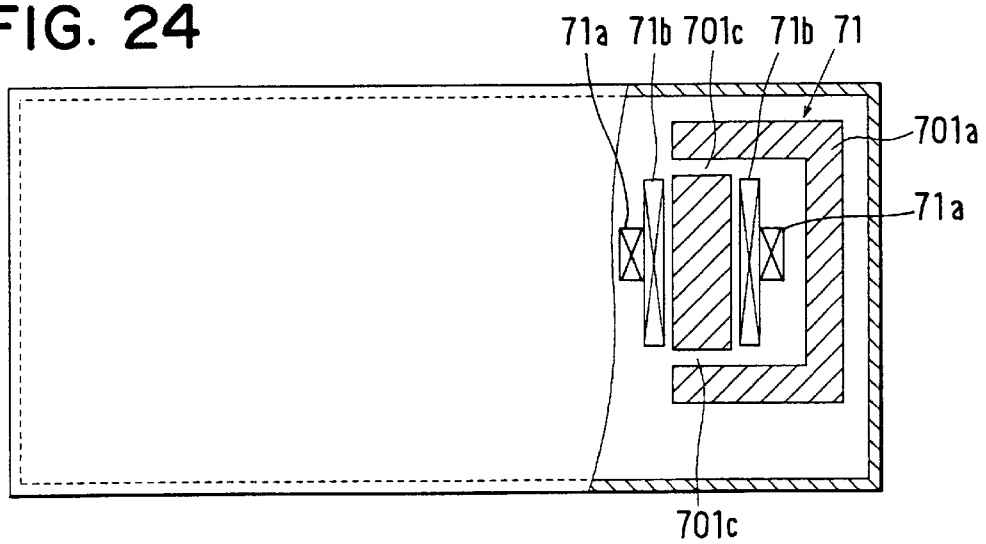
FIG. 24 is a partial cross sectional view showing a further example in which the gap of the closed magnetic circuit core is provided at a central side in the ballast casing.

It is to be noted that the gap 701*c* of the closed magnetic circuit core 701*a* may be provided at two positions at the central part in the ballast casing 710 as shown in FIG. 24.

If the gap 701*c* is provided at the other side in the ballast casing 710 in the longitudinal direction, that is, at the side of the side wall 710*b*, the leakage magnetic flux can be restricted from crossing the ballast casing 710 while utilizing a wide space in the ballast casing 710. If the starter transformer 71 is disposed at the position dislocated toward one of the opposing side walls 710*c* and 710*d* in the ballast casing 710, the gap may be provided at the other one of the side walls 710*c* and 710*d*.

Further, there may be a case in which the gap 701*c* must be provided at the end part side in the ballast casing 710, that is, at the side of the side wall 710*b*, as shown in FIG. 22 from the constraint in the magnetic circuit construction or in the production. In this instance also, the lessening of performance can be restricted in consideration of the following points.

Figure 25:
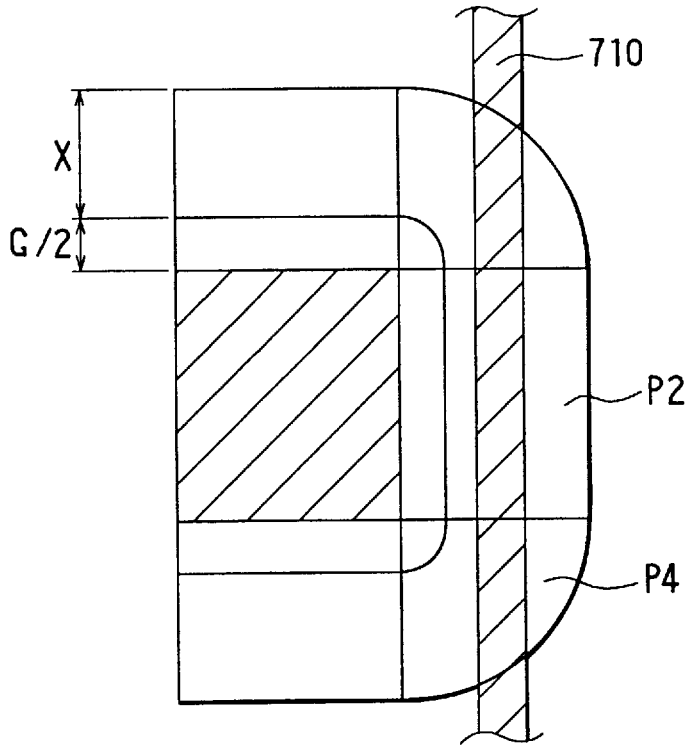
FIG. 25 is a cross sectional view showing a cross section taken along line XXV—XXV in FIG. 22.

If there exists the gap on the side of the ballast casing 710 as shown in FIG. 22, the lessening of performance increases particularly in the regions P2 and P4, which is at the side of the wall in FIG. 25 showing a cross section along line XXV—XXV. The lessening of performance calculated using the equation 1 to equation 5 with respect to various core cross sectional area S and the gap size G results in the characteristics shown in FIG. 26.

Figure 26:
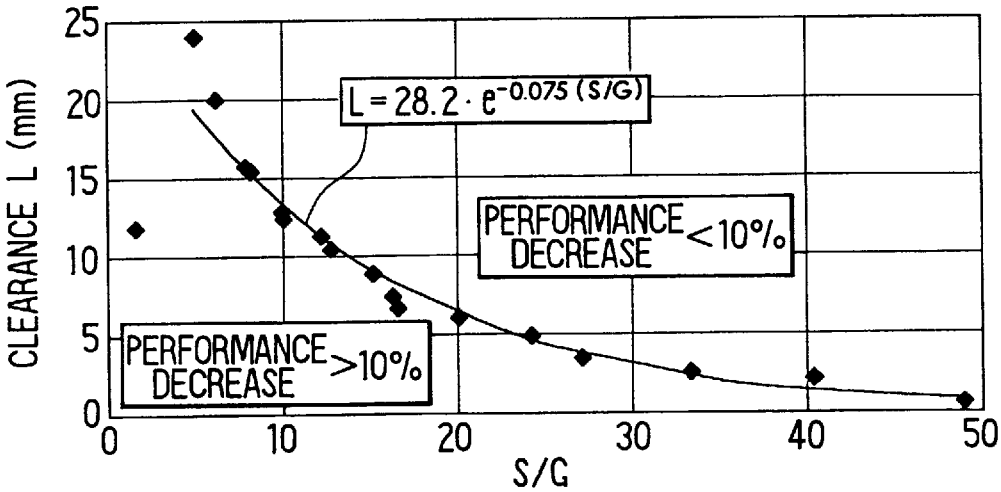
FIG. 26 is a graph showing a relation of a clearance relative to a ratio between the core cross sectional area and the gap size.

In FIG. 26, the abscissa indicates S ($mm^2$)/G (mm) and the ordinate indicates the clearance L (mm) between the inside wall of the ballast casing 710 and the gap 701*c*. The required clearance L is dependent on S/G. This means that the ratio of the leakage magnetic flux increases and hence the clearance against the ballast casing 710 is required, as the magnetic resistance (=S/$\mu$g: P5 region with no leakage magnetic flux considered) of the gap 701*c*.

As understood from FIG. 26, the lessening of performance can be restricted to less than 10% as long as the relation of $L \geqq 28.2 \cdot e^{-0.075(S/G)}$ is satisfied.

The present invention described above should not be limited to the disclosed embodiments and modifications, but may be implemented in other ways without departing from the spirit of the invention.

What is claimed is:

1. A discharge lamp apparatus having a d.c. voltage source for supplying a d.c. voltage, comprising:

a discharge lamp;

a transformer for boosting the voltage of the d.c. voltage source to produce a boosted voltage;

an inverter circuit including a plurality of switching devices for converting the boosted voltage into an a.c. voltage to supply electric power to the discharge lamp; and a fail-safe circuit for stopping a supply of electric power by turning off the plurality of switching devices according to a determination, said determination being that a voltage between the transformer and the inverter circuit is less than a predetermined voltage and that a current flowing from the inverter circuit to a negative side of the d.c. voltage source is less than a predetermined current, wherein, subsequent to said stopping, said fail-safe circuit (A) holds a turned-off condition of all among the plurality of switching devices when said determination continues for a predetermined period of time, and (B) restarts the supply of electric power otherwise.

2. A discharge lamp apparatus as in claim 1, further comprising:

a starting circuit for performing a lighting starting operation, said lighting starting operation being for starting lighting of the discharge lamp, wherein the fail-safe circuit disables said lighting starting operation upon turning off all among the plurality of switching devices and enables said lighting starting operation upon starting the supply of electric power by the plurality of switching devices.

3. A discharge lamp apparatus as in claim 1, wherein a primary side of the transformer is provided at a side of the d.c. voltage source, said primary side being connected to a voltage boosting switching device, and its secondary side which is provided at a side of the discharge lamp are in electrical conduction wherein a secondary side of the transformer is provided at a side of the discharge lamp, and wherein the transformer is constructed so that said primary side and said secondary side are in electrical conduction; and wherein said fail-safe circuit holds the voltage boosting switching device in a turned-off condition at a time when said fail-safe circuit holds a turned-off condition of all among the plurality of switching devices.

4. A discharge lamp apparatus as in claim 1, wherein:

the fail-safe circuit holds a turned-off condition of all among the plurality of switching devices at a time when said stopping a supply of electric power according to a determination continues a predetermined time or a predetermined number of times.

5. A discharge lamp apparatus as in claim 1, wherein:

the fail-safe circuit holds a turned-off condition of all among the plurality of switching devices at a time when said stopping and starting of the electric power supply by the determination continues a predetermined time or a predetermined number of times whichever occurs first.

6. A discharge lamp apparatus comprising:

a discharge lamp;

a transformer for boosting a d.c. voltage to produce a boosted voltage;

an inverter circuit for converting the boosted voltage into an a.c. voltage to supply electric power to the discharge lamp; and a fail-safe circuit for stopping a supply of electric power temporarily when it is determined that an electric wiring part between the inverter circuit and the discharge lamp is grounded, wherein, subsequent to said stopping, said fail-safe circuit restarts the supply of electric power, and wherein said fail-safe circuit stops the supply of electric power when said stopping and restarting continues for a predetermined time, wherein said fail-safe circuit holds a turned-off condition of all among a plurality of switching devices of said inverter circuit when said stopping and restarting of the supply of electric power by the determination continues for a first predetermined time, and wherein said fail-safe circuit holds a turned-off condition of all among the plurality of switching devices when an abnormality other than a grounding continues for a predetermined time longer than the first predetermined time.

7. A discharge lamp apparatus according to claim 6, wherein grounding of the discharge lamp is detected from a combination of a lamp voltage and a lamp current.

8. A discharge lamp apparatus comprising:

a discharge lamp;

a transformer for boosting a d.c. voltage so that the discharge lamp is driven by a boosted voltage;

a switching device connected to a primary side of the transformer; and electric power control means for controlling a duty ratio of the switching device based on a signal indicative of a lighting condition of the discharge lamp, wherein the power control means includes a sawtooth signal generator for generating a sawtooth signal, a limit setting circuit and a comparator for comparing the sawtooth signal and a limit signal, and wherein the limit setting circuit sets an upper limit of the duty ratio for said controlling a duty ratio, and wherein the upper limit is based on a battery voltage, a lamp voltage and a lamp current, and wherein said limit setting circuit includes means for increasing the upper limit as the lamp current decreases.

9. A discharge lamp apparatus as in claim 8, wherein said means for increasing the upper limit includes means for comparing the lamp current with a predetermined current, and wherein said means increases the upper limit when the lamp current is less than the predetermined current.

10. A discharge lamp apparatus as in claim 8, wherein said means for increasing the upper limit varies the upper limit continuously based on the lamp current.

11. A discharge lamp apparatus according to claim 8, wherein the upper limit is increased as the lamp current decreases at a time of starting lighting of the discharge lamp.

12. A discharge lamp apparatus according to claim 8, wherein the upper limit is increased when the lamp current is less than a predetermined value.

13. A discharge lamp apparatus according to claim 12, wherein the upper limit is increased at a time of starting lighting of the discharge lamp.

* * * * *